US008360906B2

(12) United States Patent
Bevier

(10) Patent No.: US 8,360,906 B2
(45) Date of Patent: Jan. 29, 2013

(54) BASKETBALL HAVING INDICIA TO ENHANCE VISIBILITY

(75) Inventor: Joseph J. Bevier, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/196,672

(22) Filed: Aug. 2, 2011

(65) Prior Publication Data

US 2011/0287879 A1 Nov. 24, 2011

Related U.S. Application Data

(62) Division of application No. 12/403,083, filed on Mar. 12, 2009, now abandoned.

(51) Int. Cl.
*A63B 41/08* (2006.01)

(52) U.S. Cl. ..... 473/604; 40/327

(58) Field of Classification Search ..... 473/603–605, 473/569; 273/DIG. 24; 40/327; D21/707, D21/713

See application file for complete search history.

(56) References Cited

U.S. PATENT DOCUMENTS

| | | | | | |
|---|---|---|---|---|---|
| 1,187,029 | A | | 6/1916 | Beebout | |
| 1,718,305 | A | | 6/1929 | Pierce | |
| 2,149,465 | A | | 3/1939 | Riddell | |
| 2,280,314 | A | | 4/1942 | Scudder | |
| D234,213 | S | * | 1/1975 | Anderson | D21/713 |
| 4,170,352 | A | | 10/1979 | Vcala | |
| 4,345,759 | A | | 8/1982 | Nims | |
| 4,546,975 | A | | 10/1985 | Nims | |
| 4,596,389 | A | | 6/1986 | Frankowski | |
| 4,796,888 | A | * | 1/1989 | Louez | 40/327 |
| D306,470 | S | * | 3/1990 | Norman et al. | D21/713 |
| D355,685 | S | * | 2/1995 | Ross | D21/712 |
| 5,403,000 | A | | 4/1995 | Woosley | |
| D365,862 | S | * | 1/1996 | Shishido et al. | D21/713 |
| D495,386 | S | | 8/2004 | Bryant et al. | |
| D498,803 | S | * | 11/2004 | Nishihara | D21/713 |
| D500,108 | S | * | 12/2004 | Carbonero | D21/707 |
| D517,621 | S | * | 3/2006 | Kuehne et al. | D21/713 |
| D518,862 | S | | 4/2006 | Swiszcz et al. | |
| D519,175 | S | * | 4/2006 | Nishihara | D21/713 |
| 7,041,015 | B2 | | 5/2006 | Sowders | |
| D546,911 | S | * | 7/2007 | Kirschbaum et al. | D21/713 |
| 7,444,770 | B2 | * | 11/2008 | Wellington, Jr. | 40/327 |
| 2007/0049434 | A1 | | 3/2007 | Maziarz et al. | |

* cited by examiner

*Primary Examiner* — Steven Wong
(74) *Attorney, Agent, or Firm* — Plumsea Law Group, LLC

(57) ABSTRACT

A spheroidal ball includes a body having three grooves that define divisions on the ball. The ball includes a first color and a second color that contrasts with the first color. The second color may be applied in various regions, areas, or sections of the ball to enhance the visibility of the ball in use.

16 Claims, 23 Drawing Sheets

BASKETBALL HAVING INDICIA TO ENHANCE VISIBILITY

BACKGROUND

The standard design for a basketball has remained virtually unchanged for decades. U.S. Pat. No. 1,718,305 is an early example of a basketball design, and that design is generally the same as that in use today. FIG. 1 shows a standard prior art basketball 10. The basketball 10 is a generally spheroidal ball that is symmetrical about two perpendicular axes or planes 12 and 14. These axes are defined by continuous seams. An additional seam 16 defines a curvilinear shape that passes through each of the quadrants defined by the perpendicular planes. If the basketball 10 were to be cut along the seam 16, the basketball 10 would be seen to be formed from two identical pieces that are somewhat in the shape of an hourglass or figure eight.

Basketballs have been designed in the past with a variety of colors imprinted thereon. For example, the WNBA uses a ball that includes both orange and white surfaces. The ABA previously used a ball with red, white, and blue surfaces. In addition, various novelty balls, such as mini basketballs, have been designed to commemorate various events and sports teams. Finally, basketballs have been designed with a white portion to allow them to be used as signed items. However, no basketball has been designed that includes contrasting portions that are designed to accentuate difference and improve the visibility of the basketball.

SUMMARY

In one embodiment, a spheroidal ball includes a body that has an exterior surface having a surface area and a circumference. First, second, and third grooves are on the body. Each groove defines about half the surface area of the body. The first and second grooves define planes that are perpendicular to one another. The third groove is curvilinear. The third groove divides the exterior surface into a first section colored with a first color and a second section colored with a second color that contrasts with the first color.

In this embodiment, the grooves may be black. The first and second grooves may be discontinuous and may not extend around the entire circumference of the body. The first groove may be discontinuous in a region where the first groove would pass through the second section. The second groove may be discontinuous in a region where the second groove would pass through the first section.

In this embodiment, the first color may be generally brown or generally orange. The second color may be have a dominant wave length between about 520 nm and about 770 nm. The first and second colors may be matte.

In a second embodiment, a spheroidal ball includes a body that has an exterior surface that has a surface area and a circumference. First, second, and third grooves are on the body. Each groove defines about half the surface area of the body. The first and second grooves define planes that are perpendicular to one another. The third groove is curvilinear. The body is made of a material that has a first color and the grooves are colored with a second color that contrasts with the first color.

In this embodiment, the third groove may divide the exterior surface into a first section and a second section. The first and second grooves may be discontinuous and may not extend around the entire circumference of the body. The first groove may be discontinuous in a region where the first groove would pass through the second section. The second groove may be discontinuous in a region where the second groove would pass through the first section.

The first section and the second section may each have a generally hourglass shape. Each of the first section and the second section may have a first end and a second end. A portion of each first end and each second end may be colored with the second color.

The first color may be generally orange or generally brown. The second color may have a dominant wavelength between about 520 nm and about 770 nm. The first and second colors may be matte.

In a third embodiment, a spheroidal ball includes a body that has an exterior surface having a surface area and a circumference. First, second, and third grooves are on the body. Each groove defines about half the surface area of the body. The first and second grooves define planes that are perpendicular to one another. The third groove is curvilinear. The third groove divides the exterior surface into a first section and a second section. The first and second sections have a first color. A first area on the first section between the first groove and the third groove is colored with a second color that contrasts with the first color.

In this embodiment, the first section may have a first end and a second end. A second area on the first section between the first groove and the third groove may be colored with the second color. The first area may be near the first end and the second area may be near the second end.

The second section may have a first end and a second end. A third area on the second section between the second groove and the third groove may be colored with the second color. The third area may be near the first end of the second section. A fourth area on the second section between the second groove and the third groove may be colored with the second color. The fourth area may be near the second end of the second section.

A fifth area on the first section between the first groove and the third groove may be colored with the second color. The fifth area may be near the first end of the first section. A sixth area on the first section between the first groove and the third groove may be colored with the second color. The sixth area may be near the second end of the first section.

In a fourth embodiment, a spheroidal ball includes a body that has an exterior surface having a surface area and a circumference. First, second, and third grooves are on the body. Each groove defines about half the surface area of the body. The first, second, and third grooves define planes that are perpendicular to one another. The grooves divide the surface area of the body into eight equal and generally triangular regions. Half the regions are colored with a first color and the other half of the regions are colored with a second color. The first and second colors are contrasting colors. The regions are colored such that no two regions that share a line segment also share a color.

In this embodiment, the first color may be generally orange or generally brown. The second color have a dominant wavelength between about 520 nm and about 770 nm. The first and second colors may be matte.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The present invention relates to a spheroidal ball, in particular a ball that may be used as a basketball. In describing the various embodiments, the disclosure may refer to particular orientations or directions, such as top, bottom, left, right, side, and the like. Because of the shape of the ball and the manner in which is commonly used, there is no single orientation that the ball will have in common usage. Accordingly these terms should be understood to be used for convenience and commonality of description in the present disclosure, rather than being prescriptive of how the ball should be oriented in use. The directional terms will commonly be used to describe the position of various elements on a particular drawing.

In addition, various geometric terms are used in the specification. These terms are understood to refer to the standard definitions of these terms in geometry.

Also, the descriptions of the ball refer to the configuration of the outer surface of the ball. It will be understood that other elements common to a ball may be included. For example, a bladder may be placed within the body of the ball and may be filled with air to a particular pressure level. A variety of pressure levels may be appropriate for any particular game. No specific structure is necessary to allow a user to fill the body with air, but a conventional inflation valve that permits the insertion of a typical needle that may be connected to a bicycle pump or other suitable pump may be included. This type of inflation valve may be positioned anywhere desirable on the body as a designer might select.

As another example, various indicia may be present on the ball. For example, a manufacturer may place its name, logo, or other identifying indicia that would assist a user in determining the source of the ball. In addition, indicia relating to the characteristics of the ball may be included. For example, a manufacturer may include indicia stating whether the ball is of the regulation size under the rules of varying agencies, such as under NBA, NCAA or high school rules. Finally, other details, such as the appropriate inflation pressure, could be noted on the ball. These indicia may be of a variety of colors and shapes, but are not considered in determining the color of a particular portion of the ball, which is described in more detail below.

Figure 2:
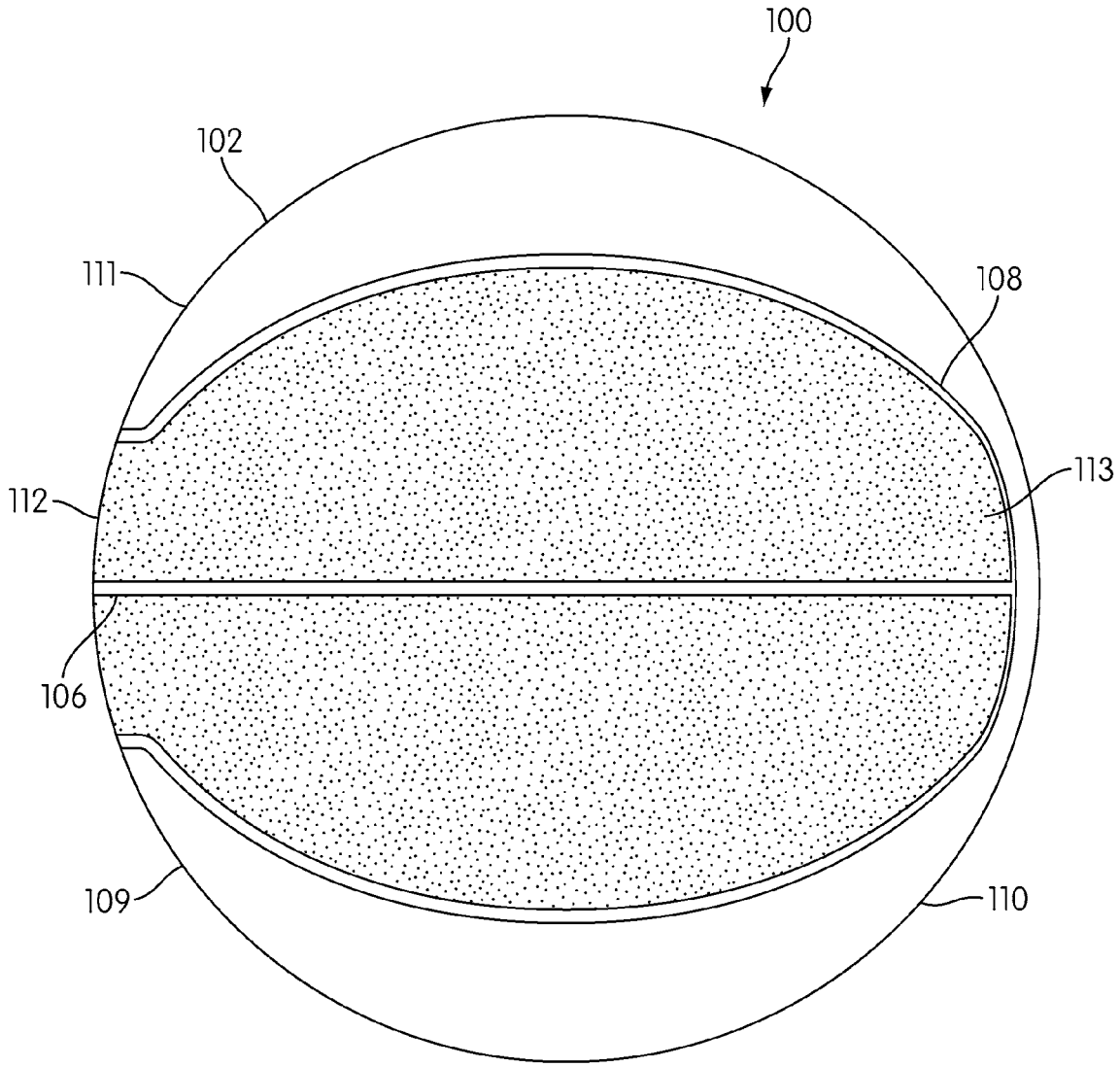
FIG. 2 is a top view of a first embodiment of a basketball.
Figure 3:
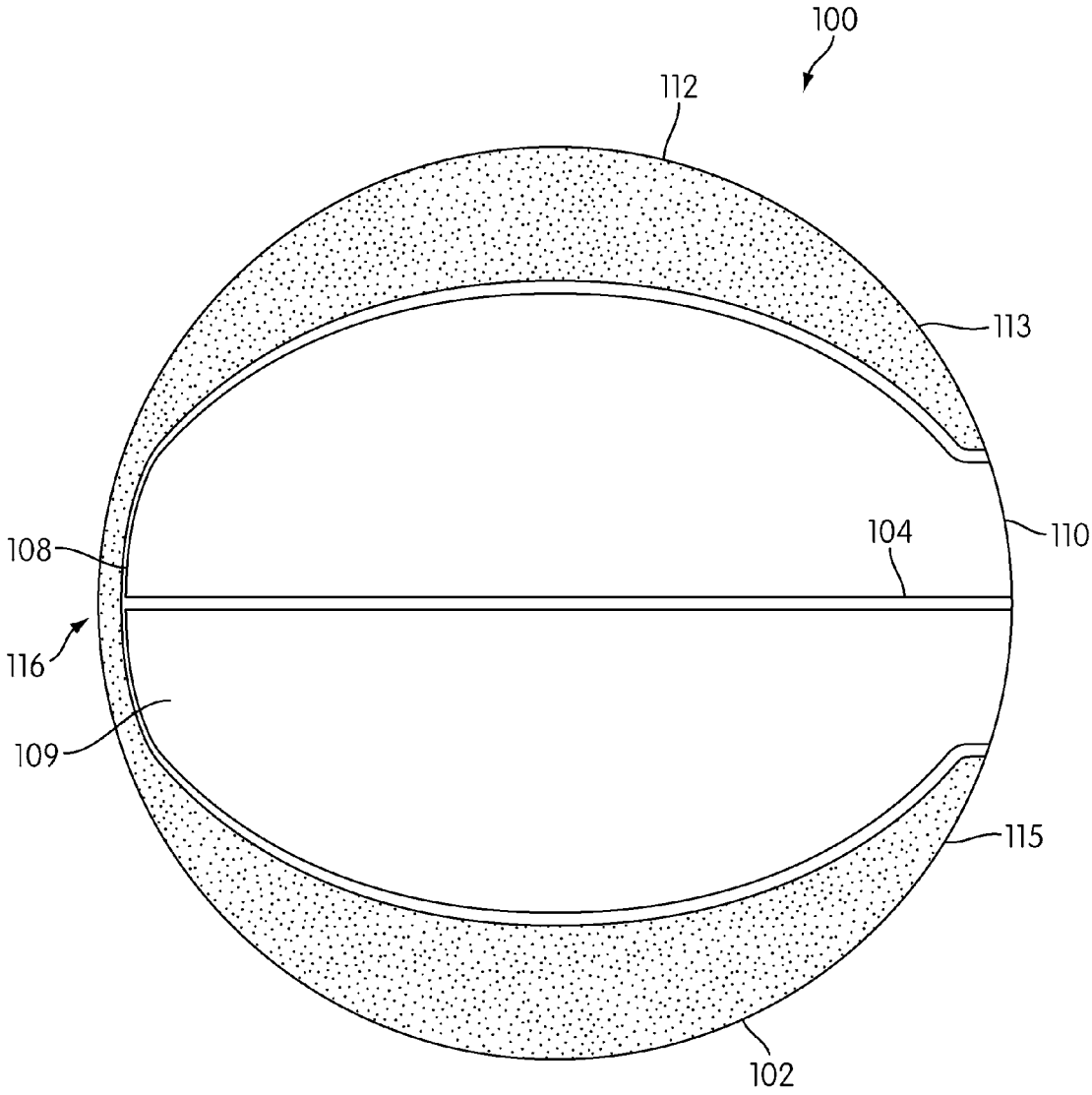
FIG. 3 is a side view of the first embodiment of the basketball.
Figure 4:
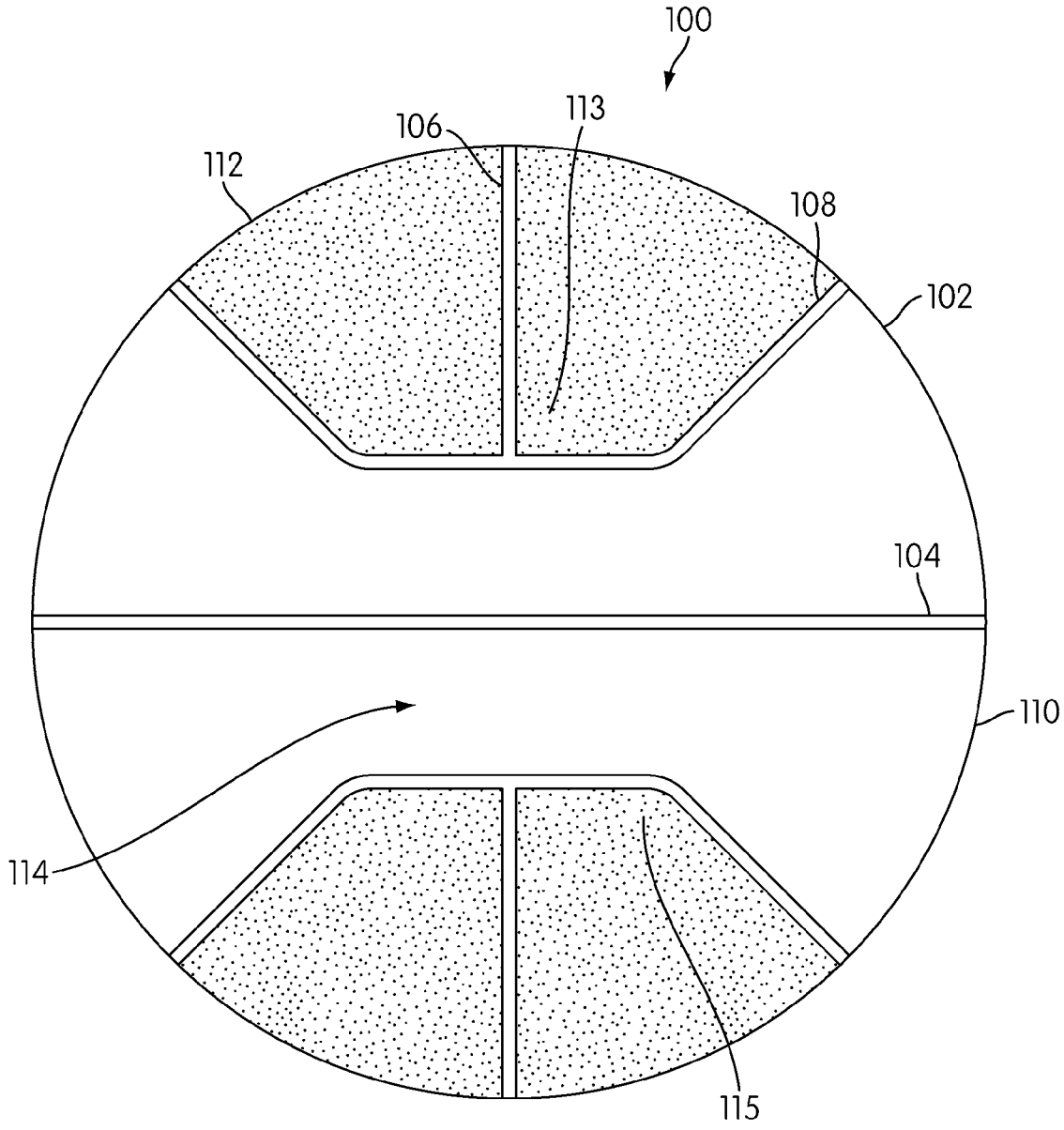
FIG. 4 is an end view of the first embodiment of the basketball.

A first exemplary embodiment is shown in FIGS. 2-4. FIGS. 2-4 show a spheroidal ball 100. The ball 100 includes a body 102 which has a surface area and a circumference. The body 102 includes a first groove 104, a second groove 106, and a third groove 108. As best seen in FIG. 4, the first groove 104 and the second groove 106 define planes perpendicular to one another. The third groove 108 is curvilinear. Each groove defines or divides the surface area of the body into halves such that about one half of the surface area of the body falls on one side of the groove and one half of the surface area of the body falls on the other side of the groove, as may be best seen in FIG. 4. In FIG. 4, the first groove 104 bisects the body 102 such that about half the surface area of the body 102 is above the first groove 104 and about half the surface area of the body 102 is below the first groove 104. The second groove 106 bisects the body 102 such that about half the surface area of the body 102 is to the left of the second groove 106 and about half the surface area of the body 102 is to the right of the second groove 106.

Third groove 108 also divides the exterior surface into a first section 110 and a second section 112. First section 110 and second section 112 each include about one half of the surface area of the body 102 and the two sections are defined by the third groove 108. The first section 110 and the second section 112 each generally have an hourglass shape. First section 110 includes a first end 109 and a second end 111. Second section 112 includes a first end 113 and a second end 115. The first section 110 is colored with a first color and the second section 112 is colored with a second color that contrasts with the first color. The grooves 104, 106, 108 are shown as being black, but may be another color if a designer deems another color more desirable.

It is to be noted that in the Figs., stippling is used. In FIGS. 2-4, for example, stippling appears in the second section 112. The stippling is used to denote where on the ball the second color appears. It is not indicative of any particular color. It is included to emphasize the difference in color between various portions or elements on the ball in the Figs.

In this embodiment, the first color is preferably an orange or brown color and the second color is a color that contrasts with the first color. The second color preferably has a dominant wavelength between about 520 nm and about 770 nm.

The first color and second color are preferably matte, as finishes with a sheen or gloss tend to be less visible, rather than enhancing visibility. In some versions, the second color covers between about 20% and about 50% of the surface area of the ball regardless of the orientation of the ball relative to the user.

It is noted that the second groove 106 is discontinuous in a region 114 where the second groove 106 would otherwise cross the first section 110. Instead, the second groove 106 is present only in the second section 112 and is bounded by the third groove 108. Similarly, the first groove 104 is discontinuous in a region 116 where the first groove 104 would otherwise cross the second section 112. Instead, the first groove 104 is present only in the first section 110 and is bounded by the third groove 108. Because of the geometric arrangements of the three grooves, the first groove 104 bisects the first section 110 longitudinally and the second groove 106 bisects the second section 112 longitudinally.

Figure 5:
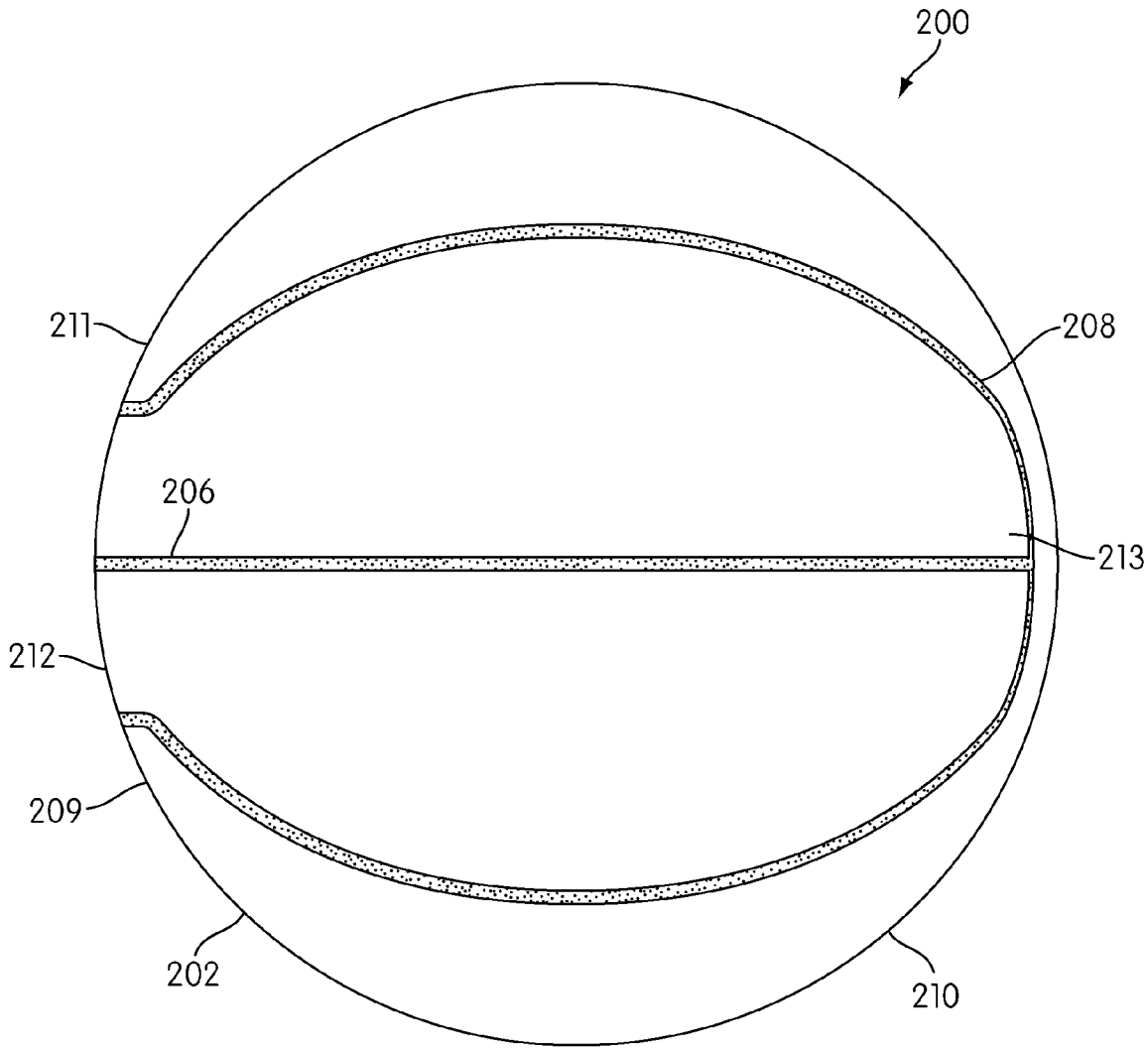
FIG. 5 is top view of a first variation of a second embodiment of the basketball.
Figure 6:
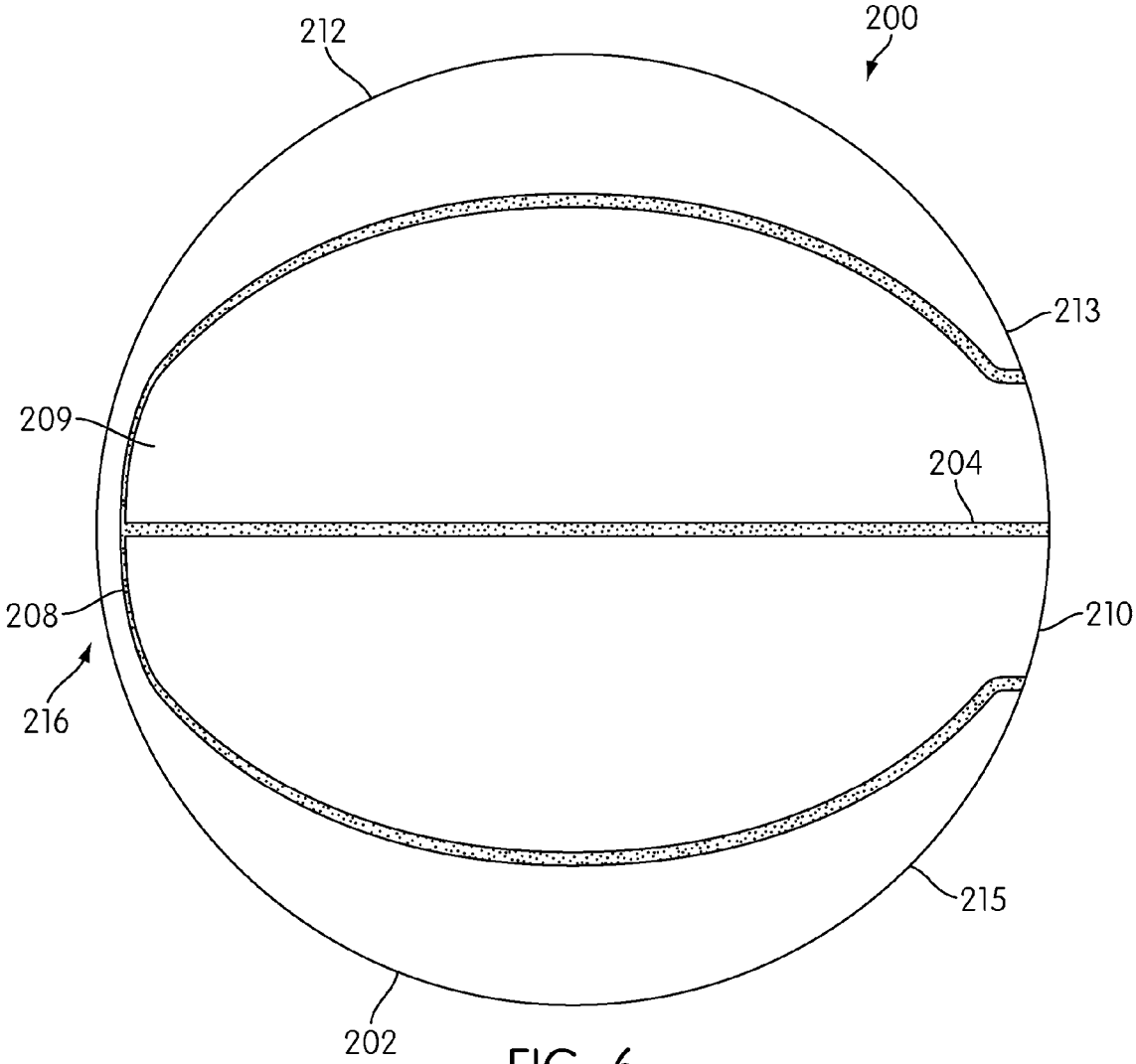
FIG. 6 is a side view of the first variation of the second embodiment of the basketball.
Figure 7:
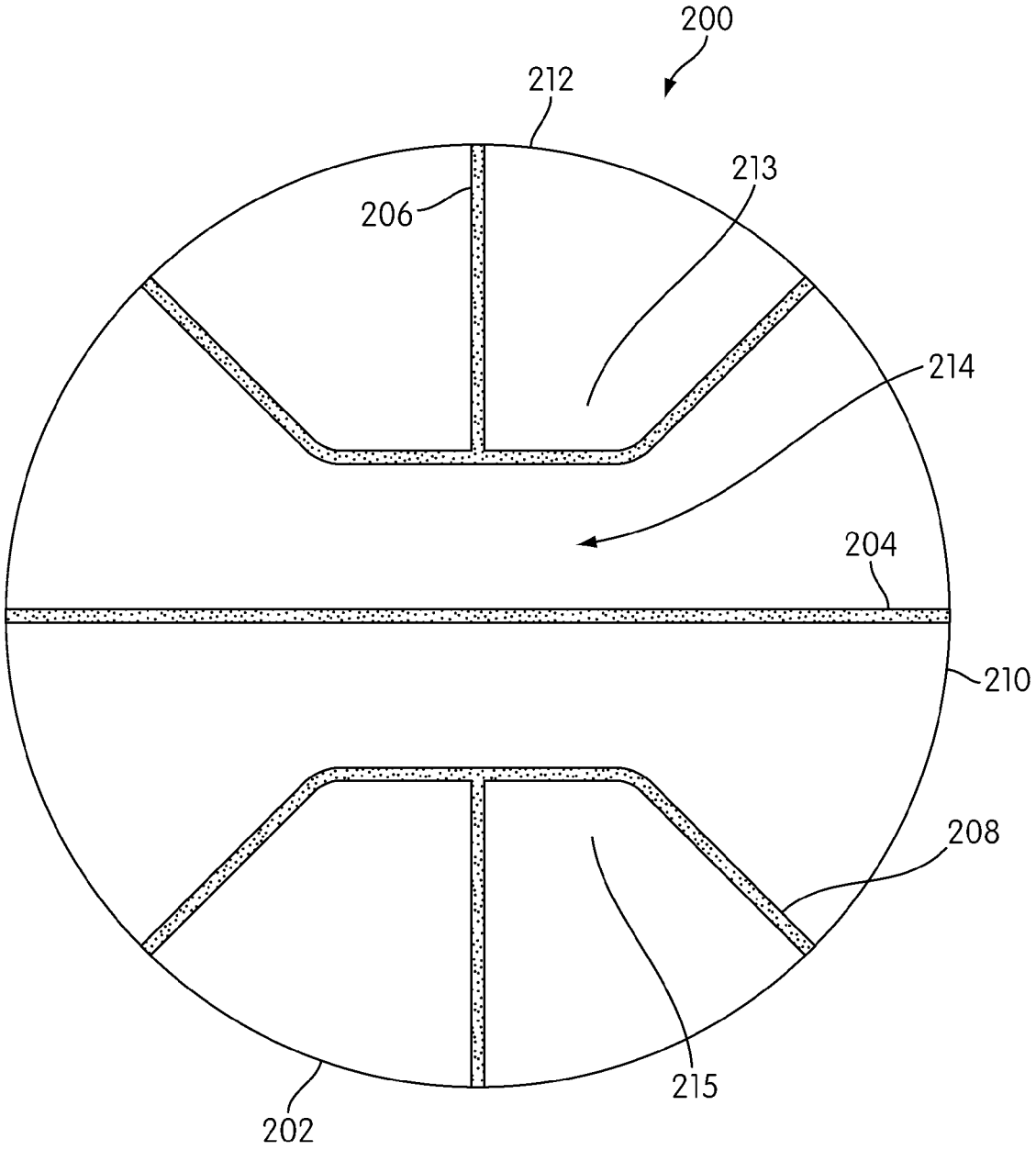
FIG. 7 is an end view of the first variation of the second embodiment of the basketball.
Figure 8:
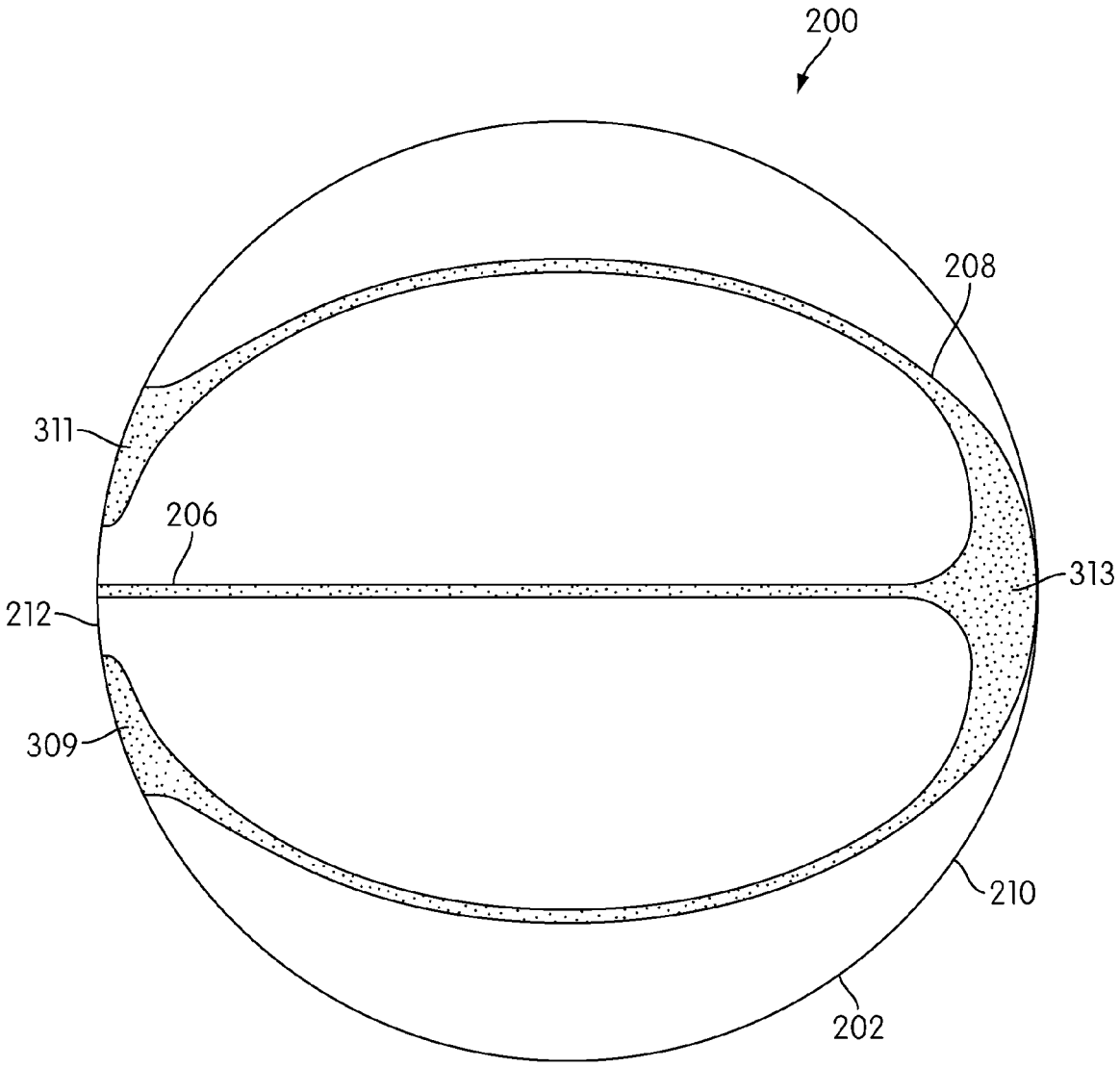
FIG. 8 is a top view of a second variation of the second embodiment of the basketball.
Figure 9:
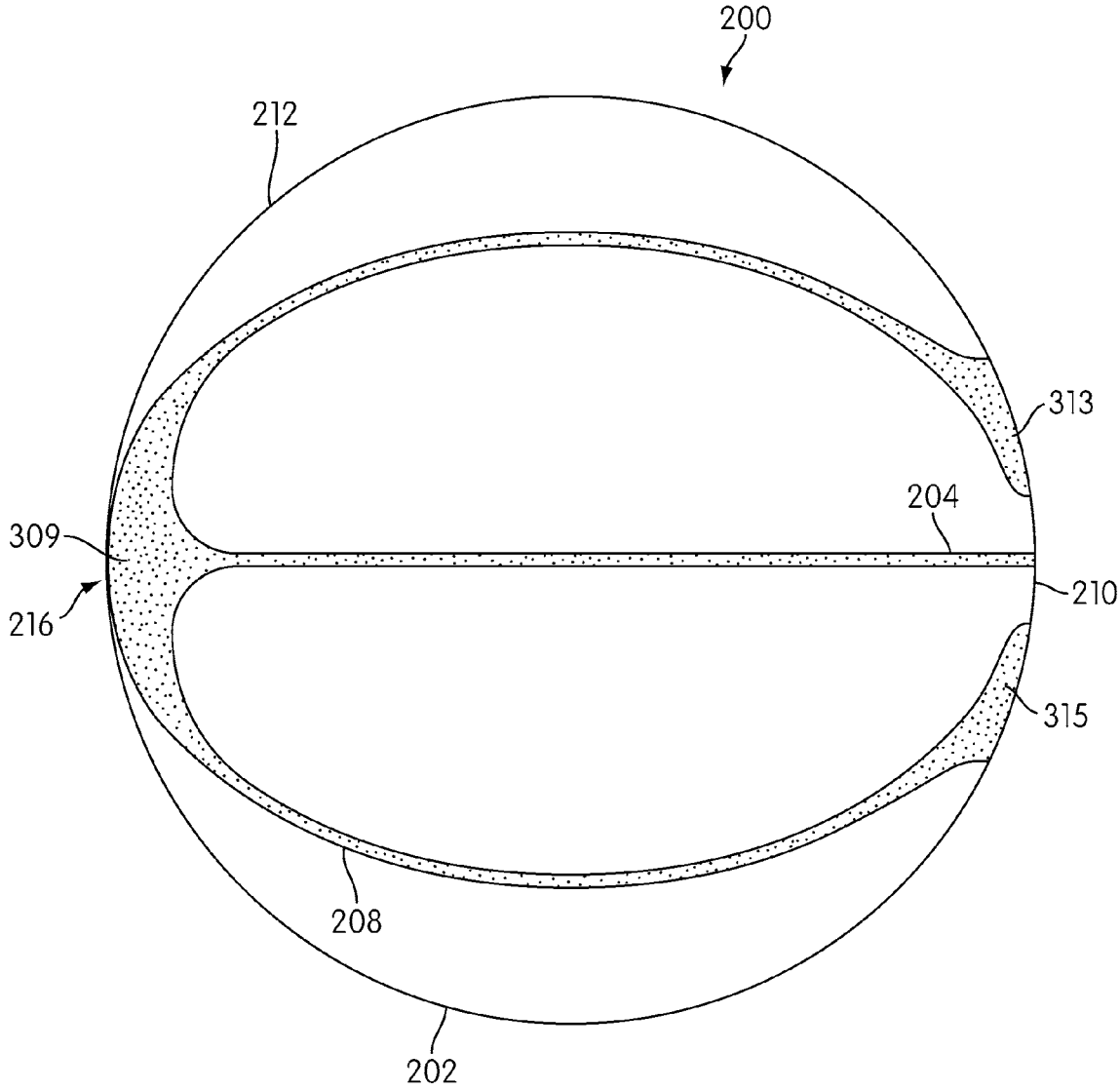
FIG. 9 is a side view of the second variation of the second embodiment of the basketball.
Figure 10:
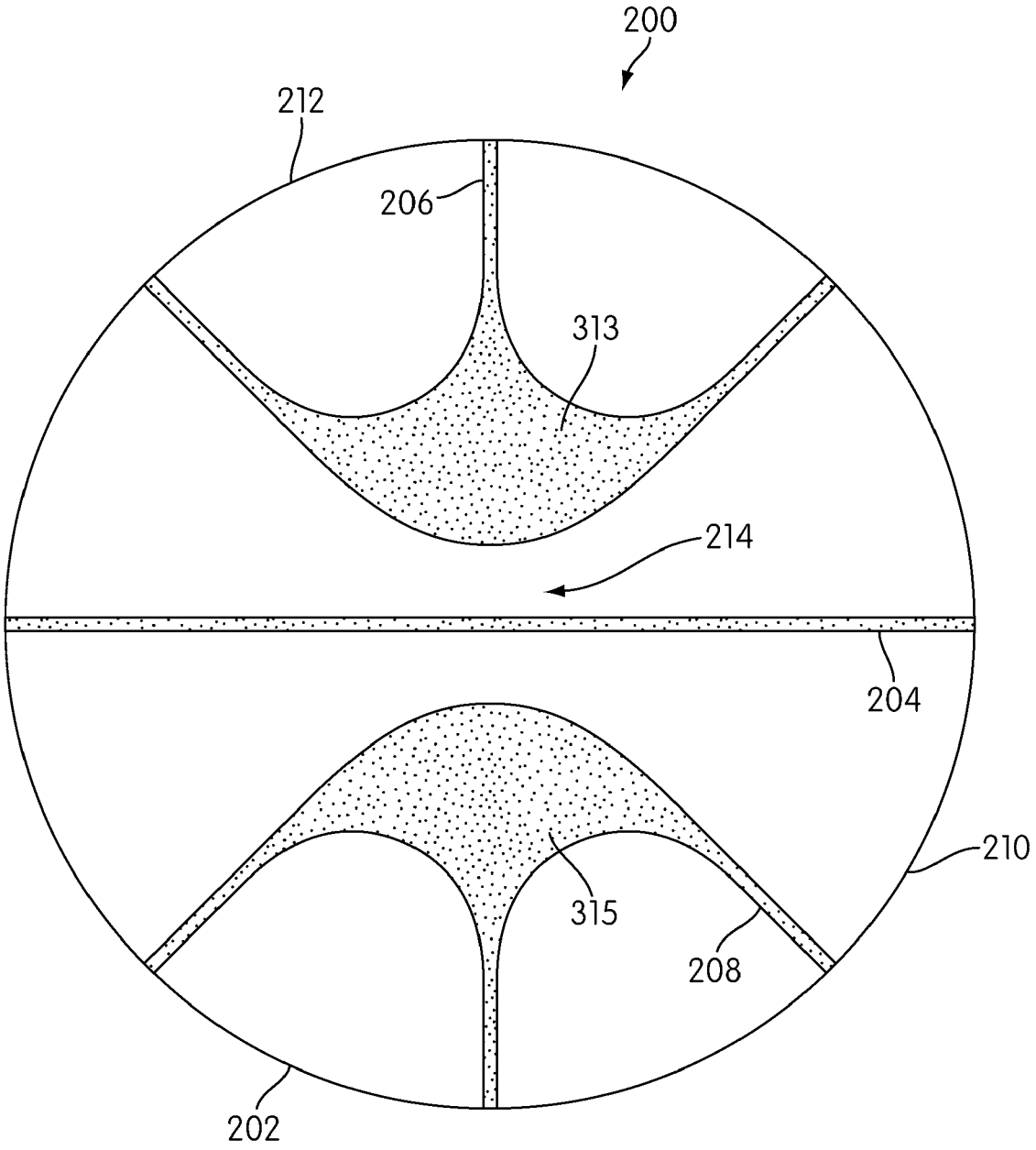
FIG. 10 is an end view of the second variation of the second embodiment of the basketball.

A second embodiment of the basketball is shown in FIGS. 5-10. A first variation of the second embodiment is shown in FIGS. 5-7, and a second variation of the second embodiment is shown in FIGS. 8-10.

Turning first to FIGS. 5-7, FIGS. 5-7 show a spheroidal ball 200. The ball 200 includes a body 202 which has a surface area and a circumference. The body 202 includes a first groove 204, a second groove 206, and a third groove 208. As best seen in FIG. 7, the first groove 204 and the second groove 206 define planes perpendicular to one another. The third groove 208 is curvilinear. Each groove defines or divides the surface area of the body into halves such that about one half of the surface area of the body falls on one side of the groove and one half of the surface area of the body falls on the other side of the groove, as may be best seen in FIG. 7. In FIG. 7, the first groove 204 bisects the body 202 such that about half the surface area of the body 202 is above the first groove 204 and about half the surface area of the body 202 is below the first groove 204. The second groove 206 bisects the body 202 such that about half the surface area of the body 202 is to the left of the second groove 206 and about half the surface area of the body 202 is to the right of the second groove 206.

Third groove 208 also divides the exterior surface into a first section 210 and a second section 212. First section 210 and second section 212 each include about one half of the surface area of the body 202 and the two sections are defined by the third groove 208. The first section 210 and the second section 212 each generally have an hourglass shape. First section 210 includes a first end 209 and a second end 211. Second section 212 includes a first end 213 and a second end 215.

In this embodiment, the body 202 is made of a material having a first color. The grooves 204, 206, 208 are colored with a second color that contrasts with the first color. In this embodiment, the first color is preferably an orange or brown color and the second color is a color that contrasts with the first color. The second color preferably has a dominant wavelength between about 520 nm and about 770 nm. The first color and second color are preferably matte, as finishes with a sheen or gloss tend to be less visible, rather than enhancing visibility. In some versions, the second color covers between about 20% and about 50% of the surface area of the ball regardless of the orientation of the ball relative to the user.

It is noted that the second groove 206 is discontinuous in a region 214 where the second groove 206 would otherwise cross the first section 210. Instead, the second groove 206 is present only in the second section 212 and is bounded by the third groove 208. Similarly, the first groove 204 is discontinuous in a region 216 where the first groove 204 would otherwise cross the second section 212. Instead, the first groove 204 is present only in the first section 210 and is bounded by the third groove 208. Because of the geometric arrangements of the three grooves, the first groove 204 bisects the first section 210 longitudinally and the second groove 206 bisects the second section 212 longitudinally.

A second variation of the second embodiment is shown in FIGS. 8-10. The variation shown in FIGS. 8-10 is identical to the first variation in FIGS. 5-7 except that the configuration and coloring of the ends 209, 211, 213, 215 is modified, as a comparison of FIGS. 5-7 to FIGS. 8-10 makes evident. The ends 209, 211, 213, 215 in the first variation are squared off. The ends 309, 311, 313, 315 in the second variation are rounded. In addition, in the second variation, a portion of each first end 309, 313 and each second end 311, 315 is colored with the second color.

It will be evident to a person having ordinary skill in the art that the precise configuration of the ends of the first and second sections of the body is not critical in any of the embodiments or variations. For example, a rounded end could be used in the embodiment shown in FIGS. 2-4 or FIGS. 5-7 or any of the embodiments to follow without departing from the spirit of the particular embodiment. Similarly, the variation shown in FIGS. 8-10 could use a square end and include a portion colored with the second color without departing from the spirit of the particular embodiment. As long as the first and second sections are generally the same shape and size, the precise contours of the grooves or boundaries in any embodiment or variation can be modified in accordance with a designer's sense of aesthetics.

Figure 11:
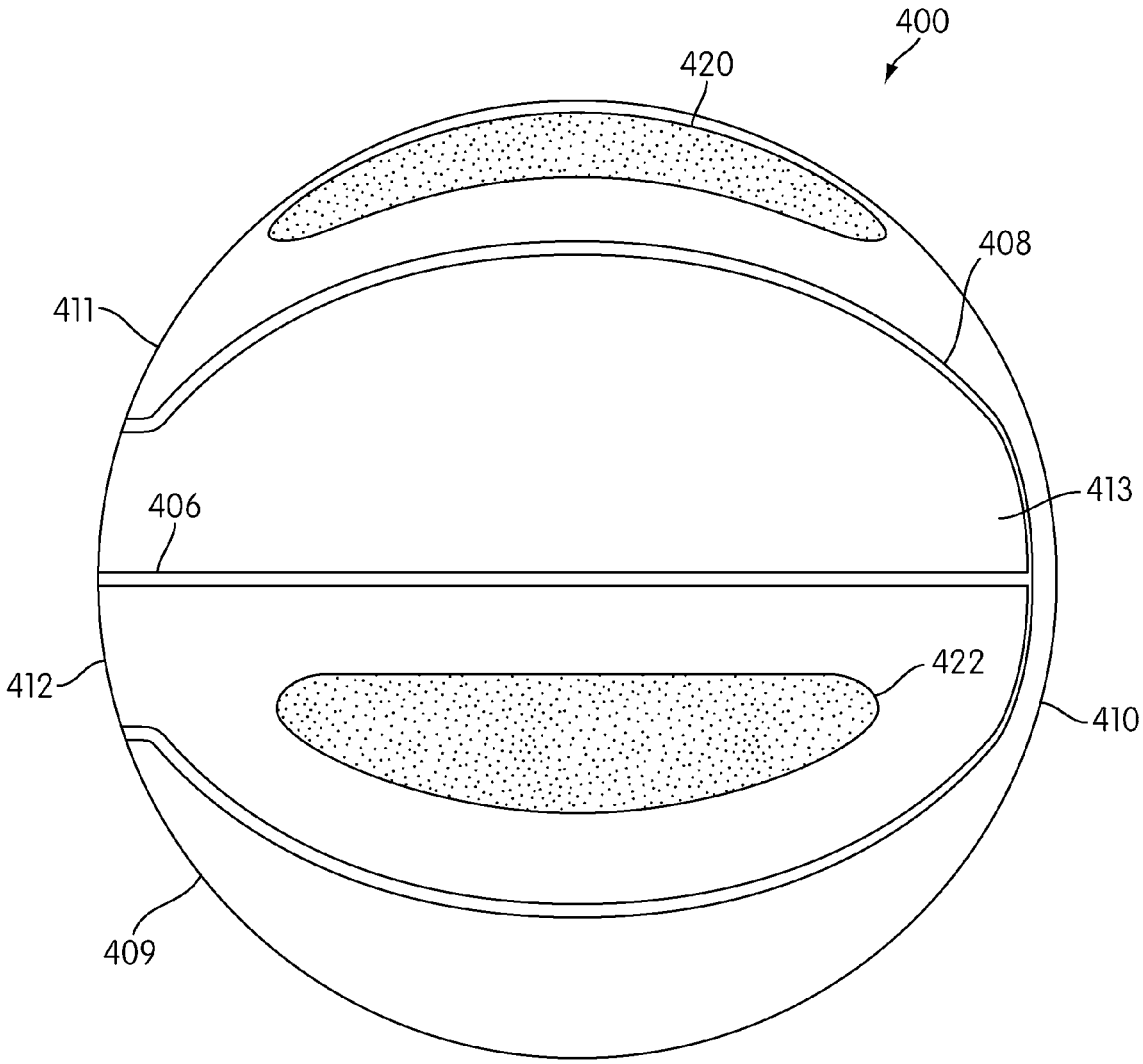
FIG. 11 is a top view of a first variation of a third embodiment of the basketball.
Figure 12:
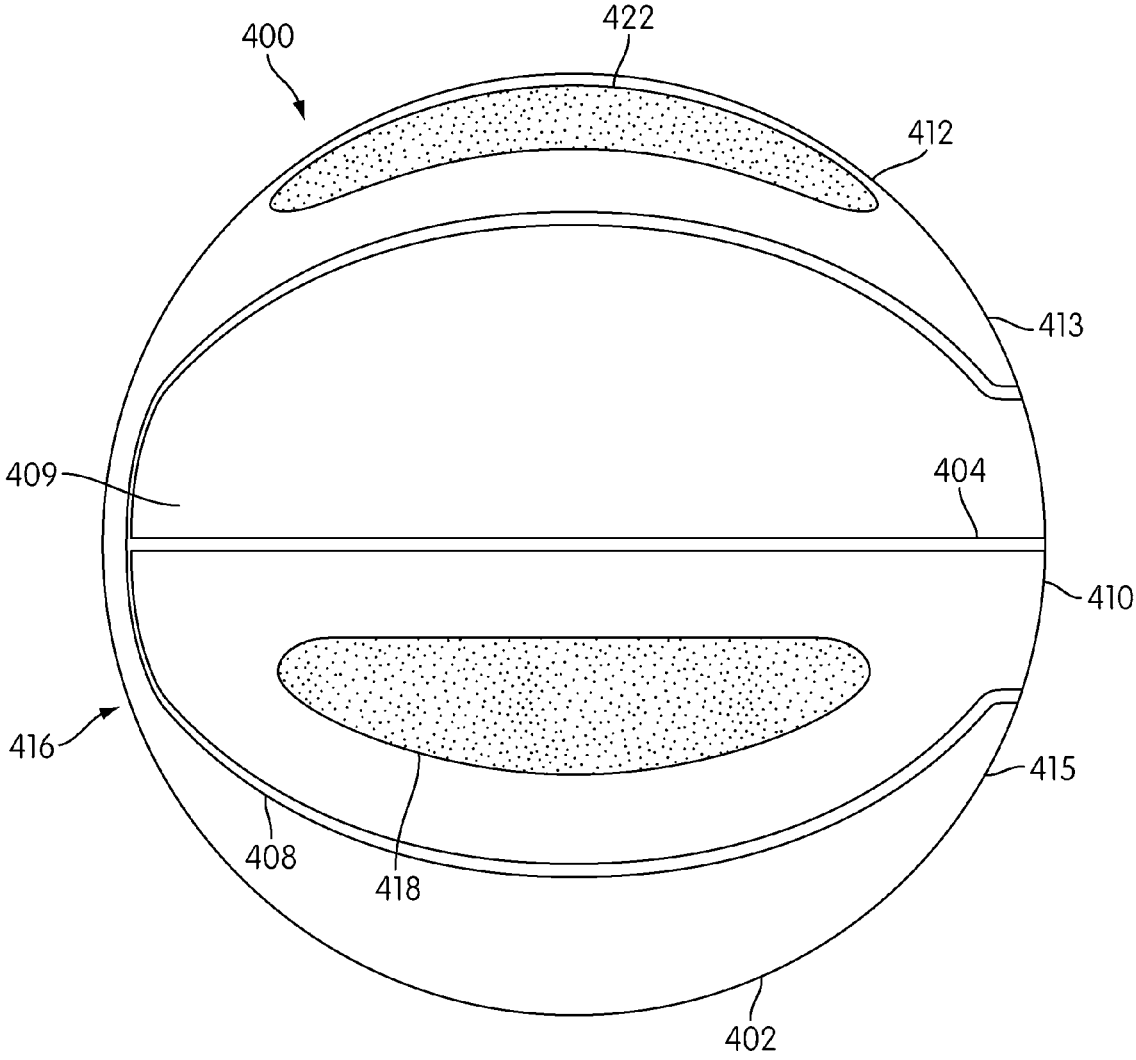
FIG. 12 is a side view of the first variation of the third embodiment of the basketball.
Figure 13:
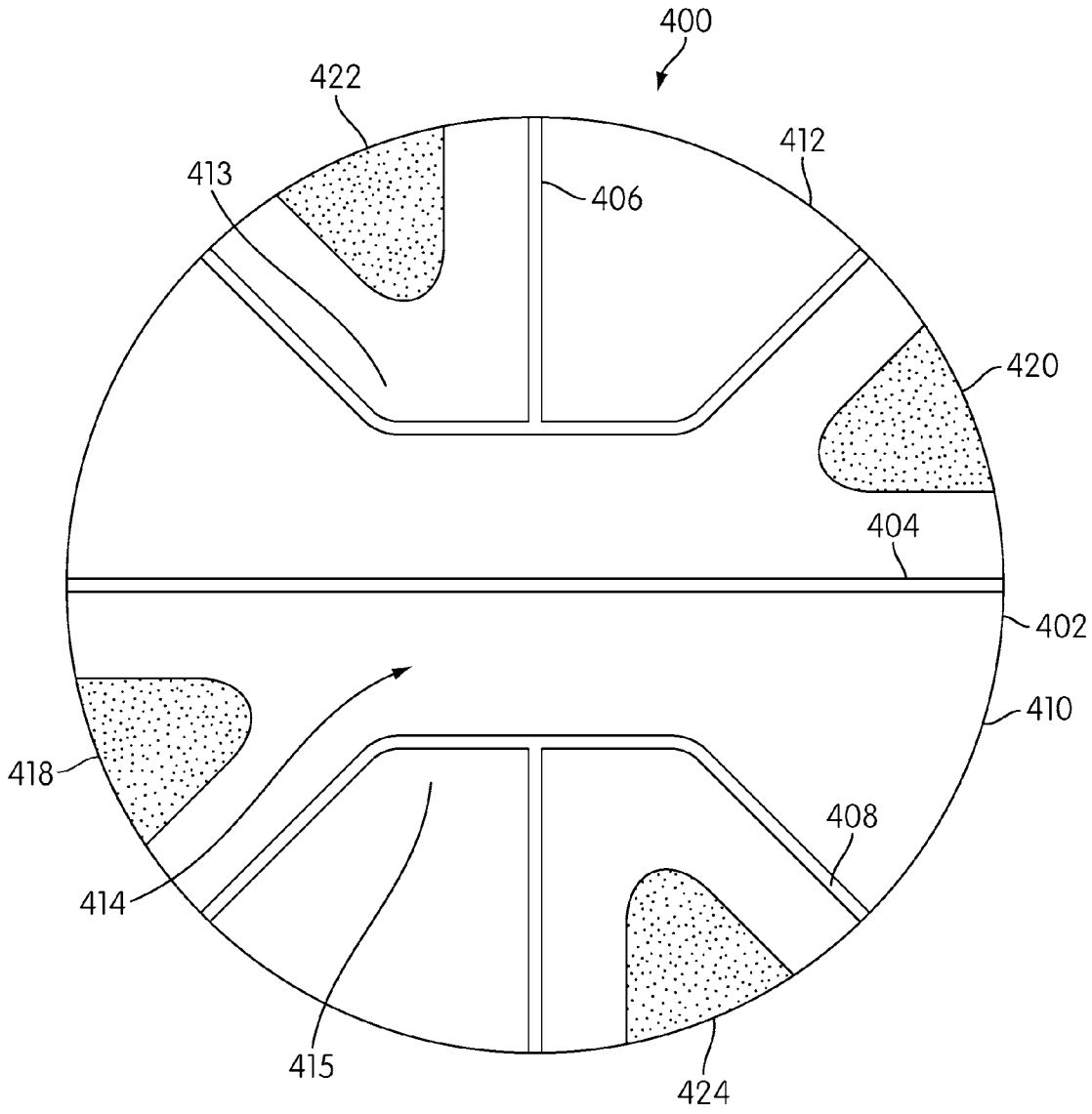
FIG. 13 is an end view of the first variation of the third embodiment of the basketball.
Figure 14:
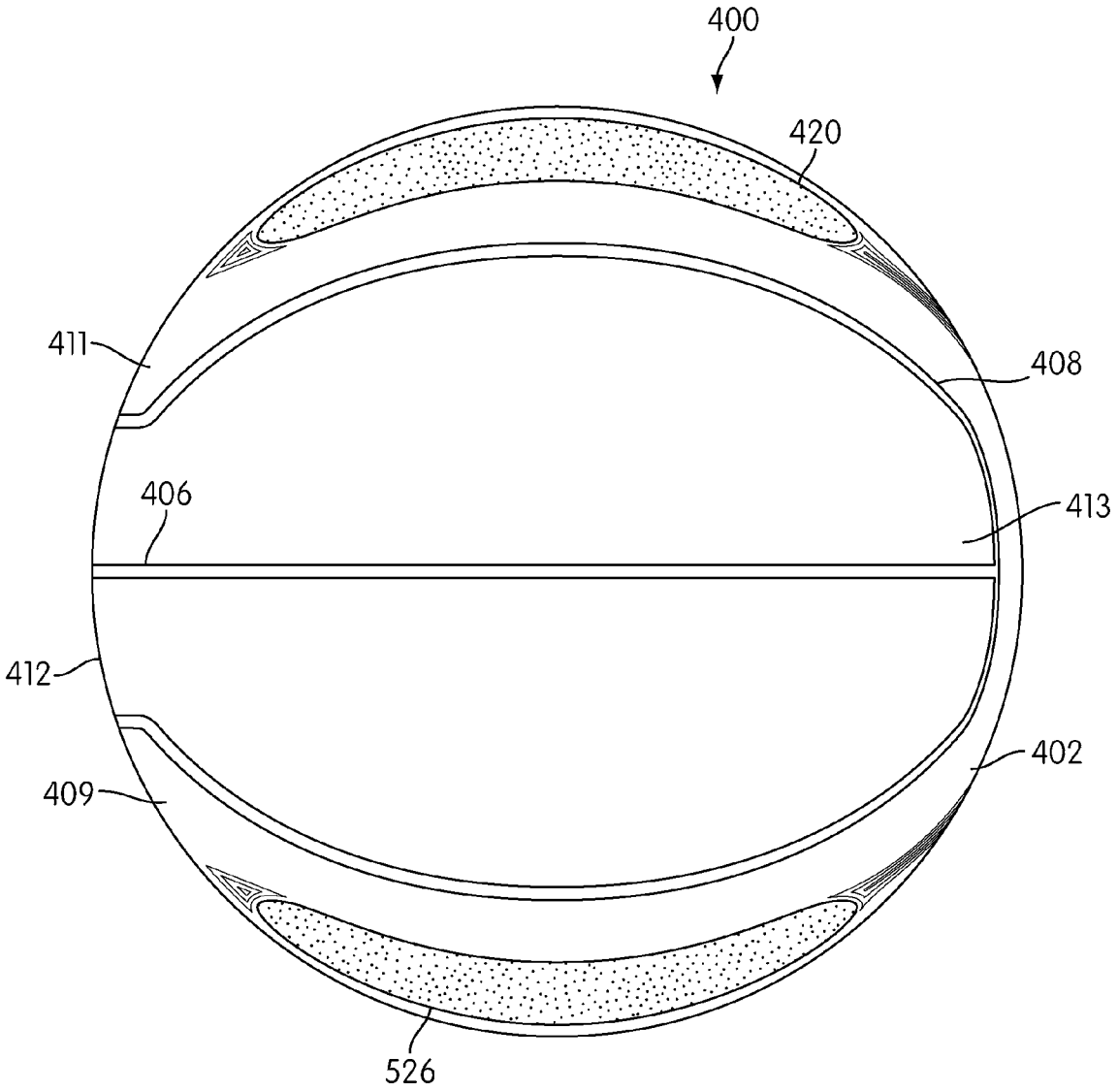
FIG. 14 is a top view of a second variation of the third embodiment of the basketball.
Figure 15:
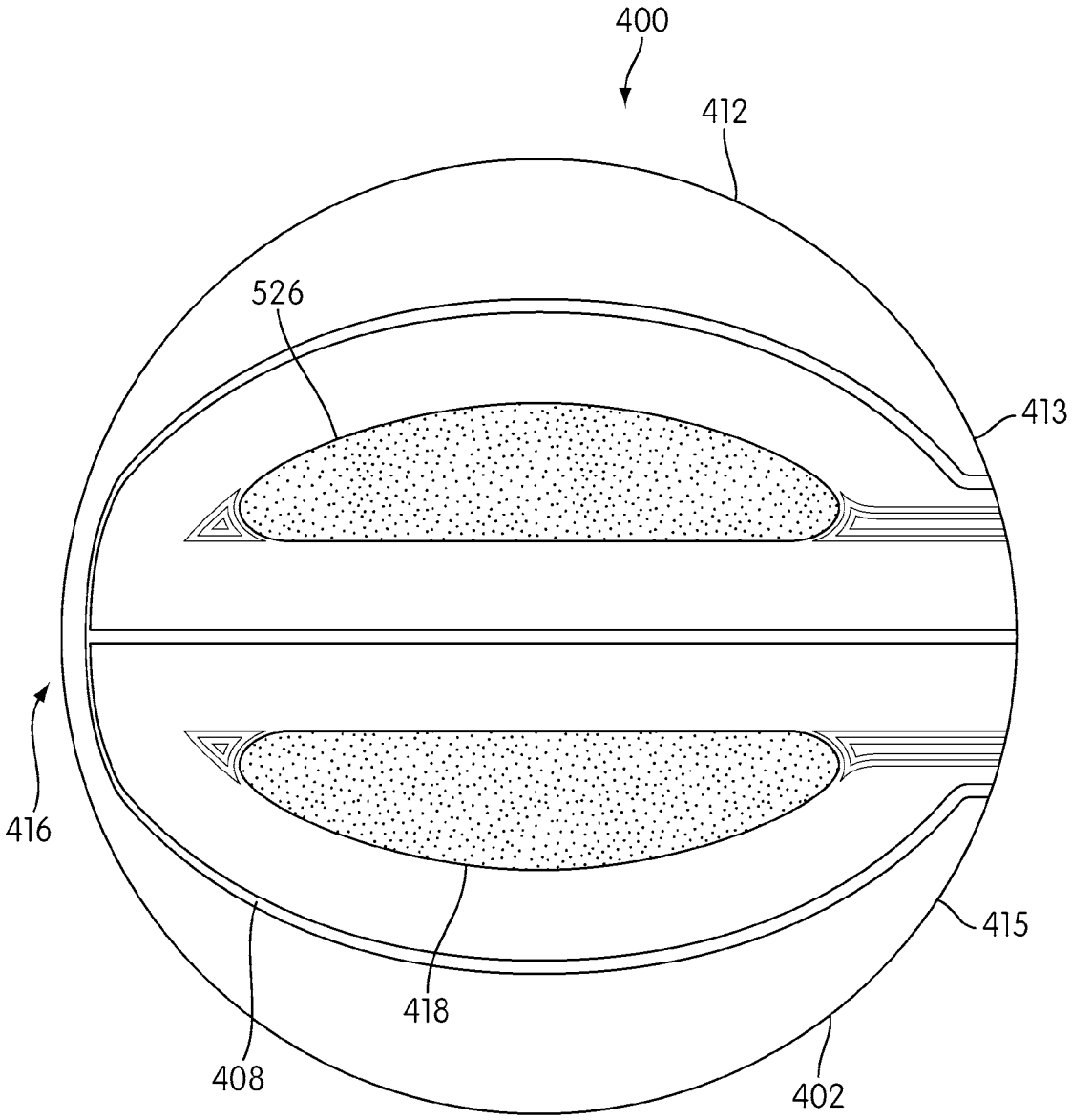
FIG. 15 is a side view of the second variation of the third embodiment of the basketball.
Figure 16:
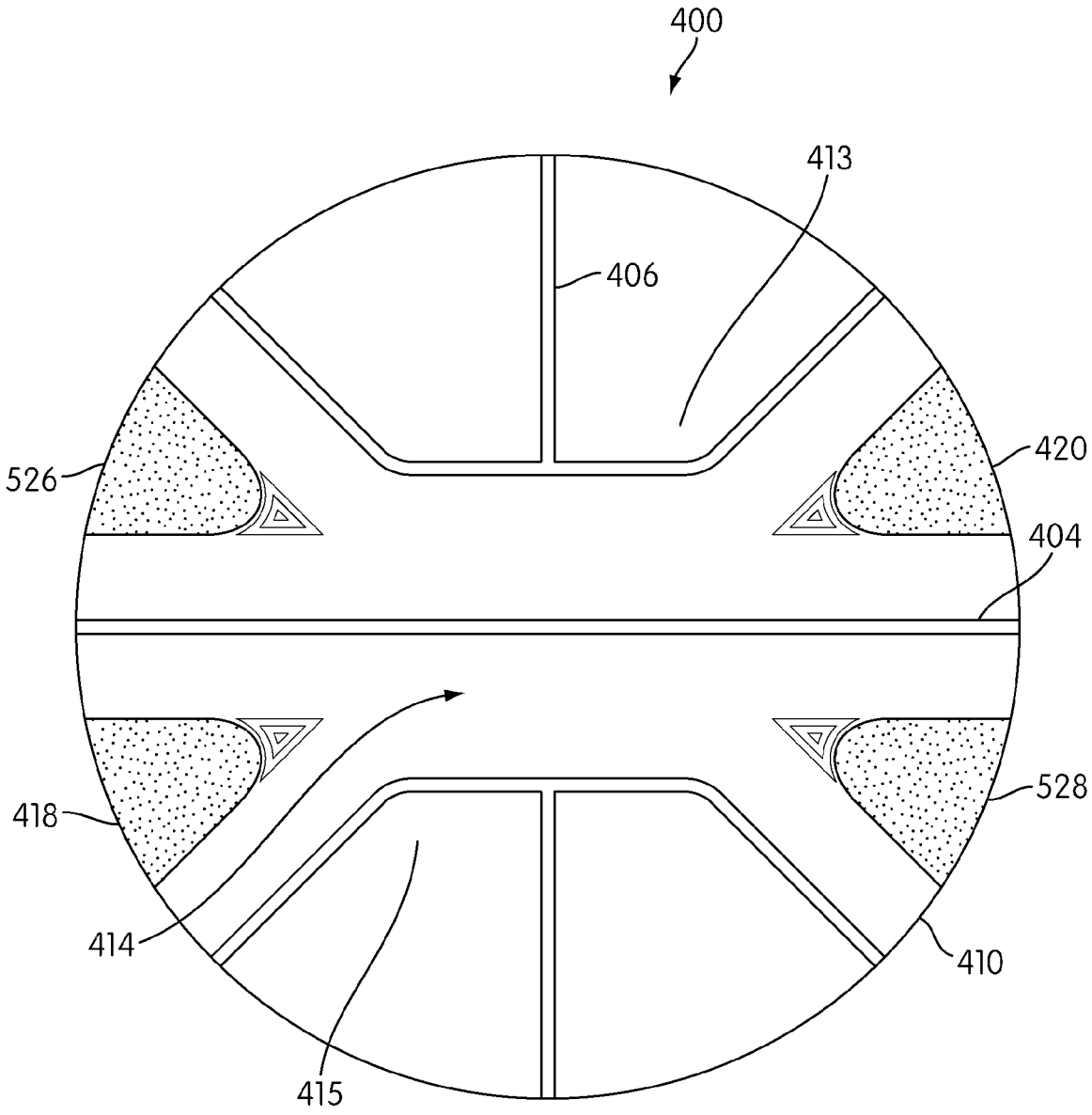
FIG. 16 is an end view of the second variation of the third embodiment of the basketball.

A third embodiment of the invention is shown in FIGS. 11-16. Many of the characteristics of this embodiment are shared with the first two embodiments. A first variation of this embodiment is shown in FIGS. 11-13 and a second variation of this embodiment is shown in FIGS. 14-16. Turning first to FIGS. 11-13, FIGS. 11-13 show a spheroidal ball 400. The ball 400 includes a body 402 which has a surface area and a circumference. The body 402 includes a first groove 404, a second groove 406, and a third groove 408. As best seen in FIG. 13, the first groove 404 and the second groove 406 define planes perpendicular to one another. The third groove 408 is curvilinear. Each groove defines or divides the surface area of the body into halves such that about one half of the surface area of the body falls on one side of the groove and one half of the surface area of the body falls on the other side of the groove, as may be best seen in FIG. 13. In FIG. 13, the first groove 404 bisects the body 402 such that about half the surface area of the body 402 is above the first groove 404 and about half the surface area of the body 402 is below the first groove 404. The second groove 406 bisects the body 402 such that about half the surface area of the body 402 is to the left of the second groove 406 and about half the surface area of the body 402 is to the right of the second groove 406.

Third groove 408 also divides the exterior surface into a first section 410 and a second section 412. First section 410 and second section 412 each include about one half of the surface area of the body 402 and the two sections are defined by the third groove 408. The first section 410 and the second section 412 each generally have an hourglass shape. First section 410 includes a first end 409 and a second end 411. Second section 412 includes a first end 413 and a second end 415.

It is noted that the second groove 406 is discontinuous in a region 414 where the second groove 406 would otherwise cross the first section 410. Instead, the second groove 406 is present only in the second section 412 and is bounded by the third groove 408. Similarly, the first groove 404 is discontinuous in a region 416 where the first groove 404 would otherwise cross the second section 412. Instead, the first groove 404 is present only in the first section 410 and is bounded by the third groove 408. Because of the geometric arrangements of the three grooves, the first groove 404 bisects the first section 410 longitudinally and the second groove 406 bisects the second section 412 longitudinally.

In this embodiment, the body 402 is made of a material having a first color. In this embodiment, the first color is preferably an orange or brown color. As in previous embodiments, the body 402 includes areas that are colored with a second color is a color that contrasts with the first color. The second color preferably has a dominant wavelength between about 520 nm and about 770 nm. The first color and second color are preferably matte, as finishes with a sheen or gloss tend to be less visible, rather than enhancing visibility. In this embodiment, the grooves 404, 406, 408 are shown as being black, but may be another color if a designer deems another color more desirable. In some versions, the second color covers between about 20% and about 50% of the surface area of the ball regardless of the orientation of the ball relative to the user.

A first area 418 colored with the second color is on the first section 410 and is positioned near first end 409 between the first groove 404 and the third groove 408, as best seen in FIG. 12. Similarly, a second area 420 is on the first section 410 and is positioned near second end 411 between the first groove 404 and the third groove 408. The first area 418 and the second area 420 are positioned on opposite sides of the first groove 404.

A third area 422 colored with the second color is on the second section 412 and is positioned near the first end 413 between the second groove 406 and the third groove 408, as is best seen in FIG. 11. Similarly, a fourth area 424 is on the second section 412 and is positioned near second end 415 between the second groove 406 and the third groove 408. The third area 422 and the second area 424 are positioned on opposite sides of the second groove 406.

In FIGS. 11-13, the areas colored with the second color 418, 420, 422, 424 are shown as somewhat following the contours of the relevant adjacent grooves 404, 406, 408, but these areas 418, 420, 422, 424 could have a different shape and size. In addition, the areas 418, 420, 422, 424 need not be a single closed curve, but instead could be a pattern, such as a series of circles placed adjacent one another in a similar location.

A second variation of the third embodiment is shown in FIGS. 14-16. The variation shown in FIGS. 14-16 is identical to the first variation in FIGS. 14-16 except that the configuration of the areas colored with the second color is modified, as a comparison of FIGS. 11-13 to FIGS. 14-16 makes evident. Both the first variation in FIGS. 11-13 and the second variation in FIGS. 14-16 include four areas that are colored with the second color. However, for ease of distinguishing between the two variations, FIGS. 11-13 are described as having a first area 418, a second area 420, a third area 422, and a fourth area 424. FIGS. 14-16 are described as having a first area 418, a second area 420, a fifth area 526, and a sixth area 528. Although FIGS. 14-16 are described as having "fifth" and "sixth" areas, only four areas are shown in either embodiment.

As was described in relation to FIGS. 11-13, now turning to FIGS. 14-16, a first area 418 colored with the second color is on the first section 410 and is positioned near first end 409 between the first groove 404 and the third groove 408, as best seen in FIG. 15. Similarly, a second area 420 is on the first section 410 and is positioned near second end 411 between the first groove 404 and the third groove 408. The first area 418 and the second area 420 are positioned on opposite sides of the first groove 404.

As also shown in FIGS. 14-16, a fifth area 526 colored with the second color is on the first section 410 and is positioned near first end 409 between the first groove 404 and the third groove 408, as best seen in FIG. 15. Similarly, a sixth area 528 is on the first section 410 and is positioned near second end 411 between the first groove 404 and the third groove 408. The fifth area 526 and the sixth area 528 are positioned on opposite sides of the first groove 404. The first area 418 and the fifth area 526 are adjacent one another near the first end 409, but on opposite sides of the first groove 404. The second area 420 and the sixth area 528 are adjacent one another near the second end 411, but on opposite sides of the first groove 404.

In FIGS. 14-16, the areas colored with the second color 418, 420, 526, 528 are shown as somewhat following the contours of the relevant adjacent grooves 404, 406, 408, but these areas 418, 420, 526, 528 could have a different shape and size. In addition, the areas 418, 420, 526, 528 need not be a single closed curve, but instead could be a pattern, such as a series of circles placed adjacent one another in a similar location.

It will be apparent to a person having ordinary skill in the art through an examination of FIGS. 11-16 that there are many different possible configurations of coloring that are possible. For example, the first section 410 could be colored as shown and described in FIGS. 14-16 while the second section 412 could be colored as shown and described in FIGS. 11-13. Such a configuration would yield six areas on the body 402 colored with the second color. Similarly, both the first section 410 and the second section 412 could be colored as the first section 410 is shown as being colored in FIGS. 14-16, thereby yielding a ball having eight areas on the body 402 colored with the second color. Indeed, a designer could decide to include one or more areas colored with the second color in any of the positions described interchangeably.

Indeed, some features of the three embodiments could be used together. For example, a designer could easily use the design shown (for example) in FIGS. 11-13 and add the grooves colored with the second color from FIGS. 5-7. Or a designer could use the configuration in FIGS. 2-4 and add areas colored with the second color as shown in FIGS. 14-16. Other combinations are, of course, possible and can be considered as being within the scope of this disclosure.

Figure 17:
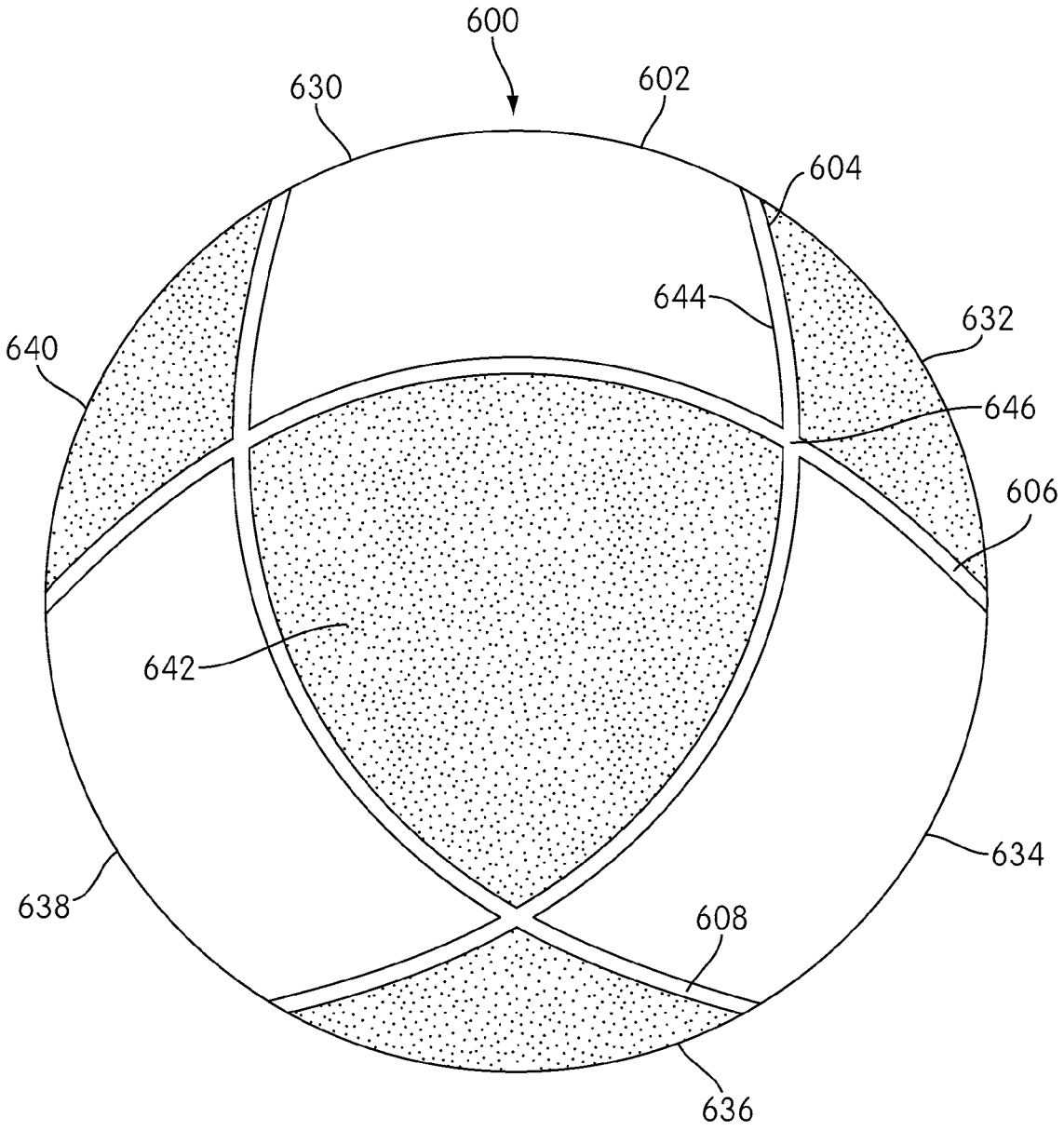
FIG. 17 is a perspective view of a fourth embodiment of the basketball.
Figure 18:
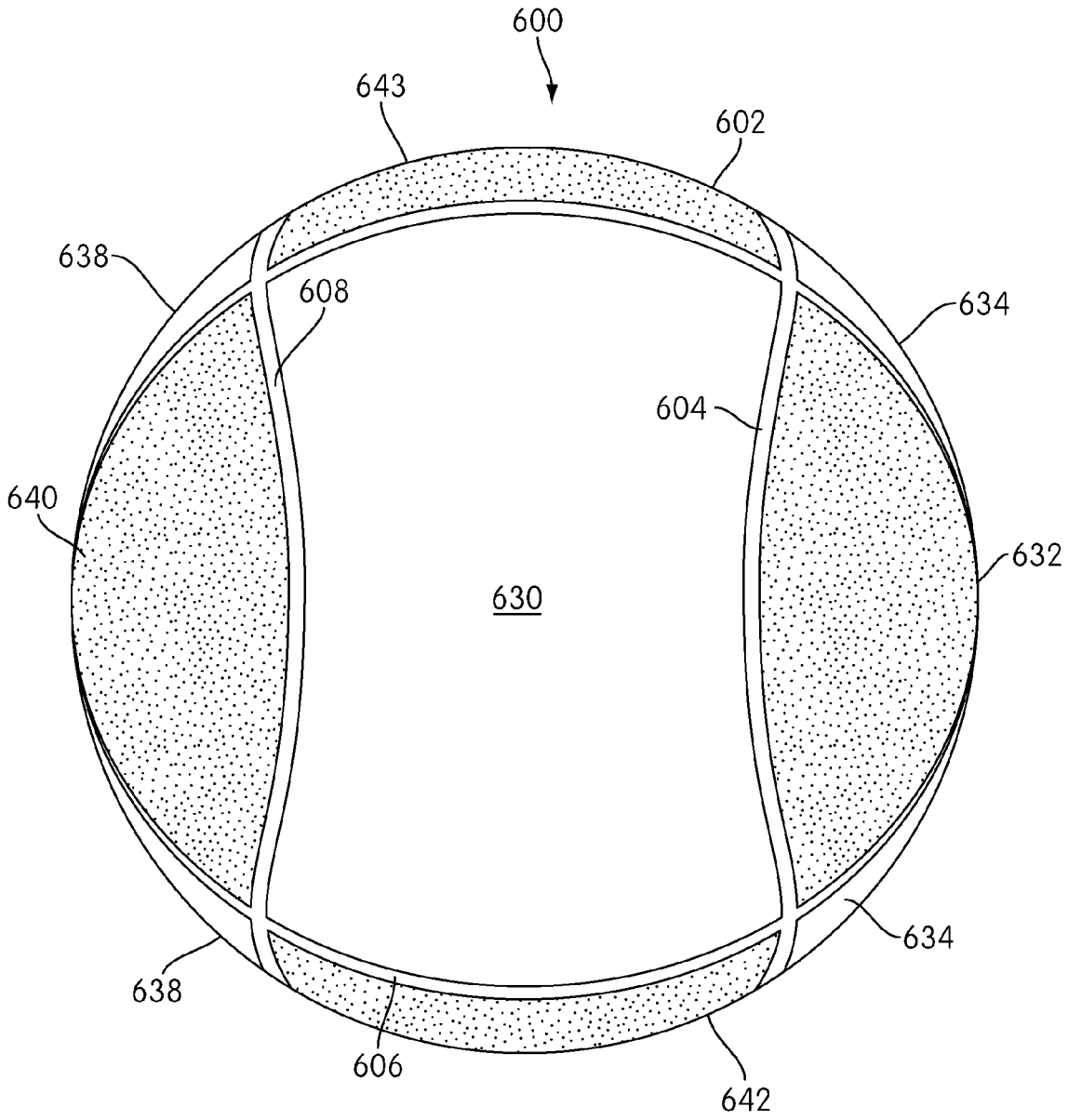
FIG. 18 is a top view of the fourth embodiment of the basketball.
Figure 19:
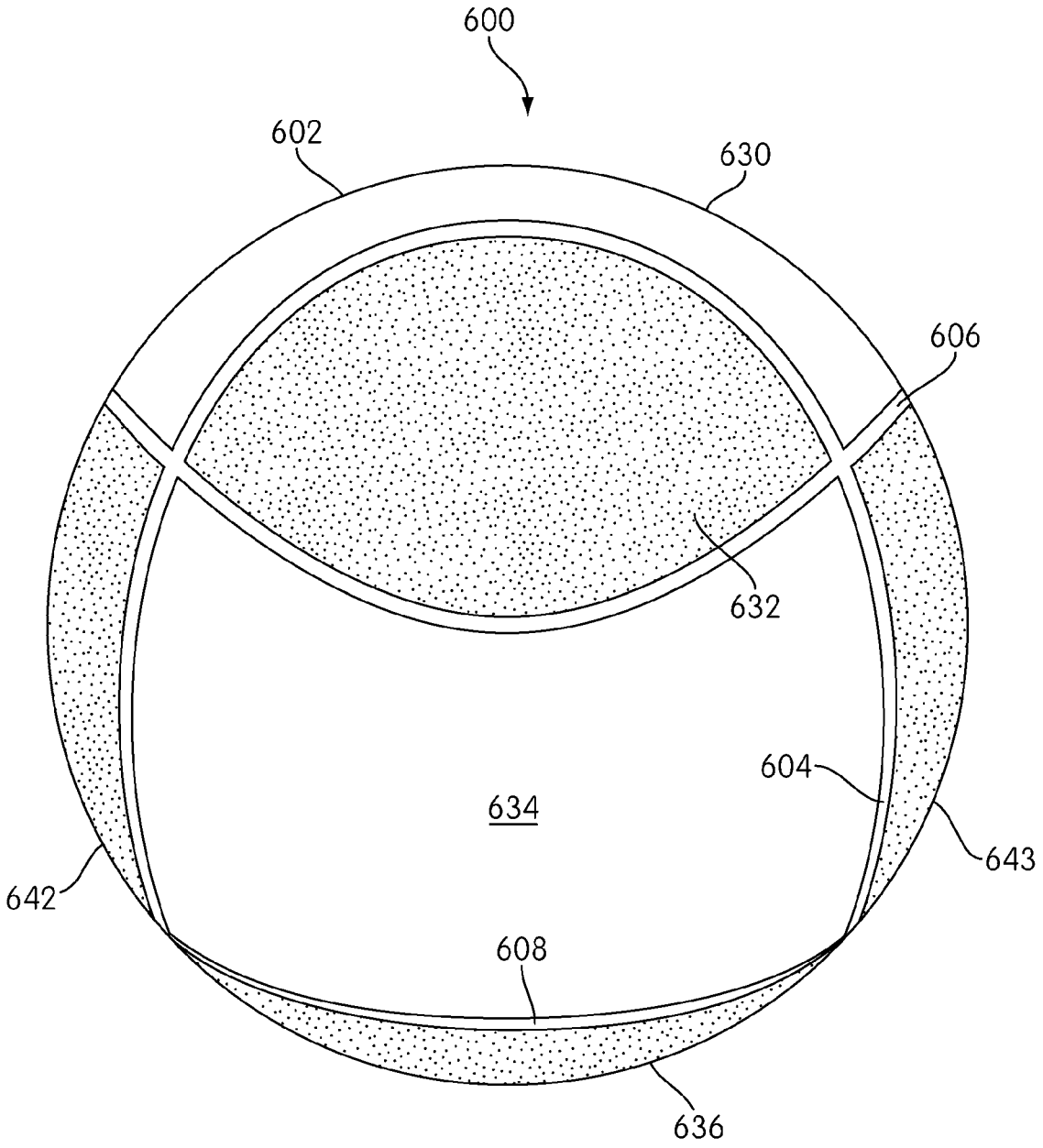
FIG. 19 is a right side view of the fourth embodiment of the basketball.
Figure 20:
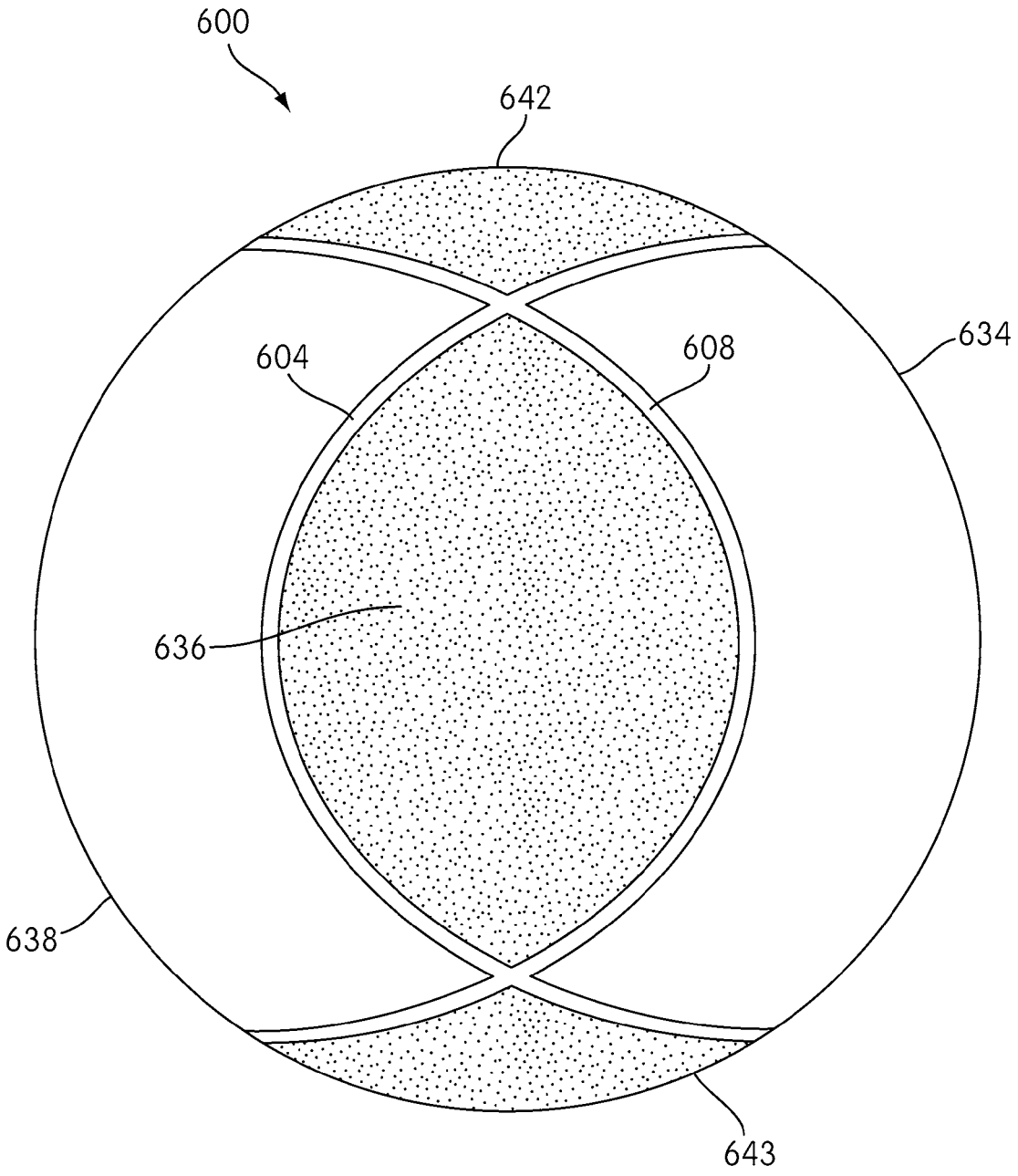
FIG. 20 is a bottom view of the fourth embodiment of the basketball.

A fourth exemplary embodiment is shown in FIGS. 17-20. FIG. 17 shows a spheroidal ball 600. The ball 600 includes a body 602 which has a surface area and a circumference. The body 602 includes a first groove 604, a second groove 606, and a third groove 608. Each groove defines or divides the surface area of the body into two uneven portions. Thus, the surface area of the body 602 is divided into eight regions 630, 632, 634, 636, 638, 640, 642, and an eighth region 643 that is not visible in this FIG. Regions 630, 634, and 638 are generally rectangular with a slight hourglass shape. Regions 632, 636, and 640 are eye-shaped. Regions 642 and the eighth region are a rounded triangular shape.

Each of the regions meets two, three, or four other regions at a line segment, such as the line segment 644 that is positioned between rectangular region 630 and eye-shaped region 632. In addition, each of the regions has two, three, or four vertices. Each region meets another region only at each of its vertices, the other not meeting the first region along a line segment. For example, rectangular region 630 and rectangular region 634 meet only at vertex 646 and they do not otherwise contact one another.

The surface area of the body 602 is colored with a first color and a second color that contrasts with the first color. Each region is colored such that no two regions that share a line segment also share a color. However, regions that meet only at a vertex share the same color. Accordingly, eye-shaped region 632 is colored with the second color. Eye-shaped region 632 meets rectangular regions 630 and 634 at line segments. Accordingly, rectangular regions 630 and 634 are colored with the first color. Similarly, eye-shaped region 632 meets triangular regions 642 and 643 only at vertices. Accordingly, triangular regions 642 and 643 are colored with the second color. This configuration allows for an alternating pattern of regions having the first color and regions having the second color across the ball. In this embodiment, because of the distribution of the areas of regions across the ball, the regions shown as being colored with the first color could instead be colored with the second color and the regions shown as being colored with the second color could instead be colored with the first color.

In this embodiment, the first color is preferably an orange or brown color and the second color contrasts highly with the first color. The second color preferably has a dominant wavelength between about 520 nm and about 770 nm. The first color and second color are preferably matte, as finishes with a sheen or gloss tend to be less visible, rather than enhancing visibility. In this embodiment, the grooves may be black, but may be another color if a designer deems another color more desirable. In some versions, the second color covers between about 20% and about 50% of the surface area of the ball regardless of the orientation of the ball relative to the user.

The embodiments discussed all include regions having a standard basketball color and a second color that contrasts with the color of a standard basketball. The use of a ball having two colors in and of itself enhances its visibility. In order to enhance visibility, it is desirable that the two contrasting colors be selected so that one is significantly lighter than the other. In addition, the colors must be selected to maintain a high degree of visibility against the background of the court flooring or traditional outdoor blacktop. In addition, the use of complementary colors is desirable. In some versions, the second color covers between about 20% and about 50% of the surface area of the ball regardless of the orientation of the ball relative to the user.

The typical color of a basketball is in the orange-brown range. The colors that would be typically considered to be "complementary" to the traditional basketball color are in the purple-violet-blue range. However, in the case of a basketball, the use of these colors is not desirable. First, the human eye is less sensitive to colors in the purple-violet-blue range, which would limit the degree of contrast and can reduce the visibility of the ball. In addition, the use of such colors together is not considered aesthetically pleasing. Accordingly, the use of those colors together is not desirable.

Instead, the use of bright yellow as the second color with the traditional basketball color is desirable. The human eye is particularly sensitive to yellow and green colors, so the use of bright yellow enhances visibility. In addition, the use of yellow is considered pleasing to the eye when placed next to a traditional basketball color. Further, the use of yellow will enhance the brightness of the ball when used in an indoor setting. Many arenas use light sources that give more yellow wavelength light than sunlight, so the yellow color will appear brighter than any other color. Finally, the use of yellow will also create contrast against the typical basketball floor. Accordingly, the use of yellow as a secondary color on a basketball is desirable.

The use of an irregular color pattern of some sort on the ball is also desirable. In playing basketball and other sports, peripheral vision is very important and an athlete's level of success at a sport is often linked to his or her ability to perceive things peripherally at a high level. A human's central vision is best at detecting detail and takes up about three percent of the visual field. Objects which are still are best perceived in this area. In the remaining area, a degree of flicker is useful to detect motion. A discontinuity in pattern or color on a basketball produces a flicker, which enables a user to more quickly detect the ball. This will tend to allow the user to recognize the ball, compute its trajectory, and determine a course of action more quickly than if the ball is a single color or pattern. In addition, the flicker particularly enhances performance in low light conditions. These abilities with respect to the disclosed embodiments were confirmed through empirical testing.

Balls having a variety of patterns were tested in the same manner. Thirteen male subjects of ages between twenty and forty were screened to ensure they had normal vision and color recognition. The subjects were then seated in a chair, and their hearing was blocked through the use of headphones. The subjects were asked to watch a video monitor at a distance of twenty feet and identify verbally the item shown on the video screen and to keep their eyes fixed on the screen. A channel was placed to each side of the subject at a distance of about nine feet and from time to time, a ball was rolled down one of the channels, and the subject pressed a button as soon as he detected the ball. Subjects were tested with variations of the embodiments shown in the present disclosure and with traditional balls. Subjects were tested with each ball on each side. In addition, the test included both detection of the ball against a black background and against a background that mimics a court floor. The results for tests using the prior art ball were averaged and the results for variations of the disclosed embodiments were averaged for clarity in showing the results.

Figure 1:
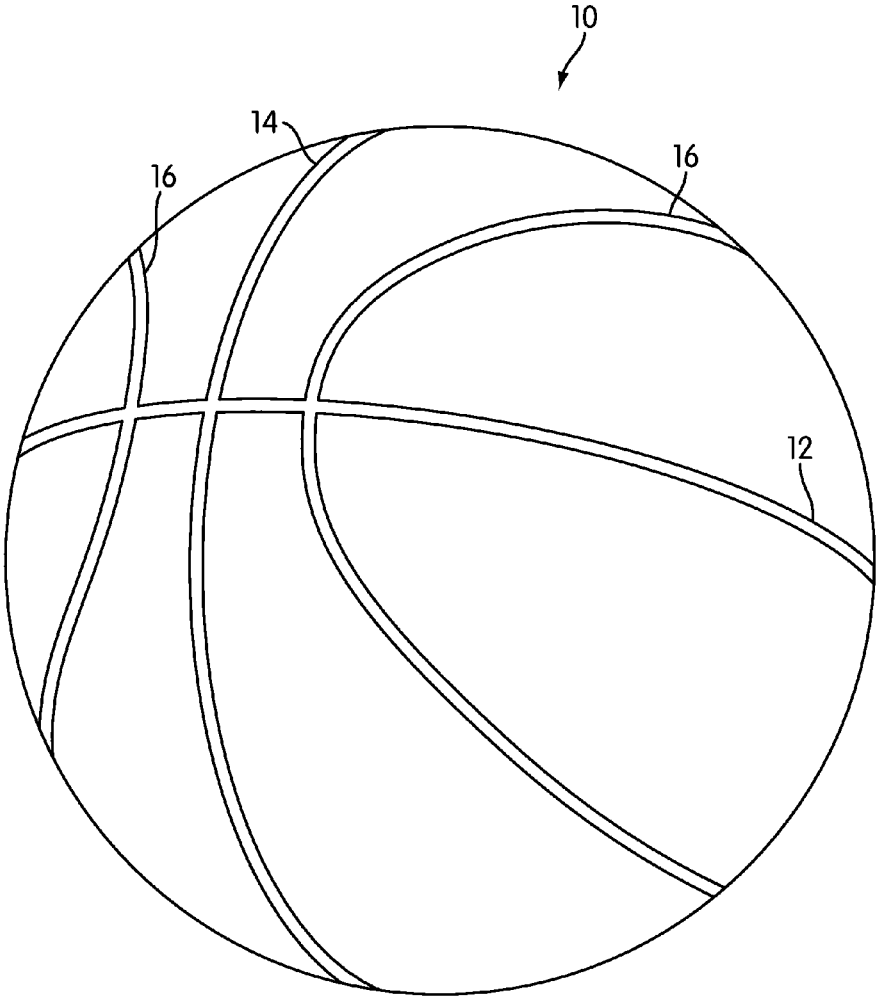
FIG. 1 PRIOR ART
FIG. 1 is a perspective view of a prior art basketball.
Figure 21:
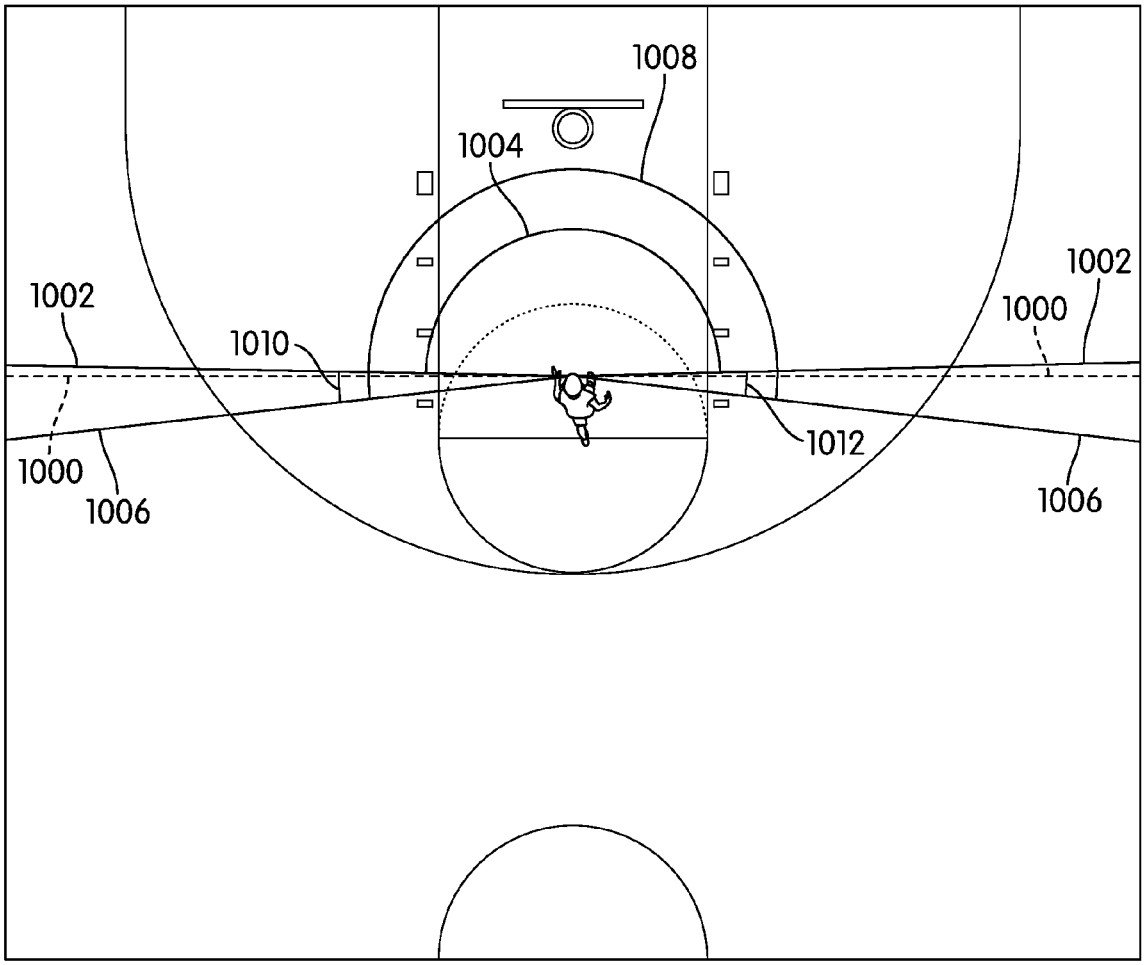
FIG. 21 is a top view of half of a basketball court showing the relative areas in which a user can perceive basketballs from the middle of the court.
Figure 22:
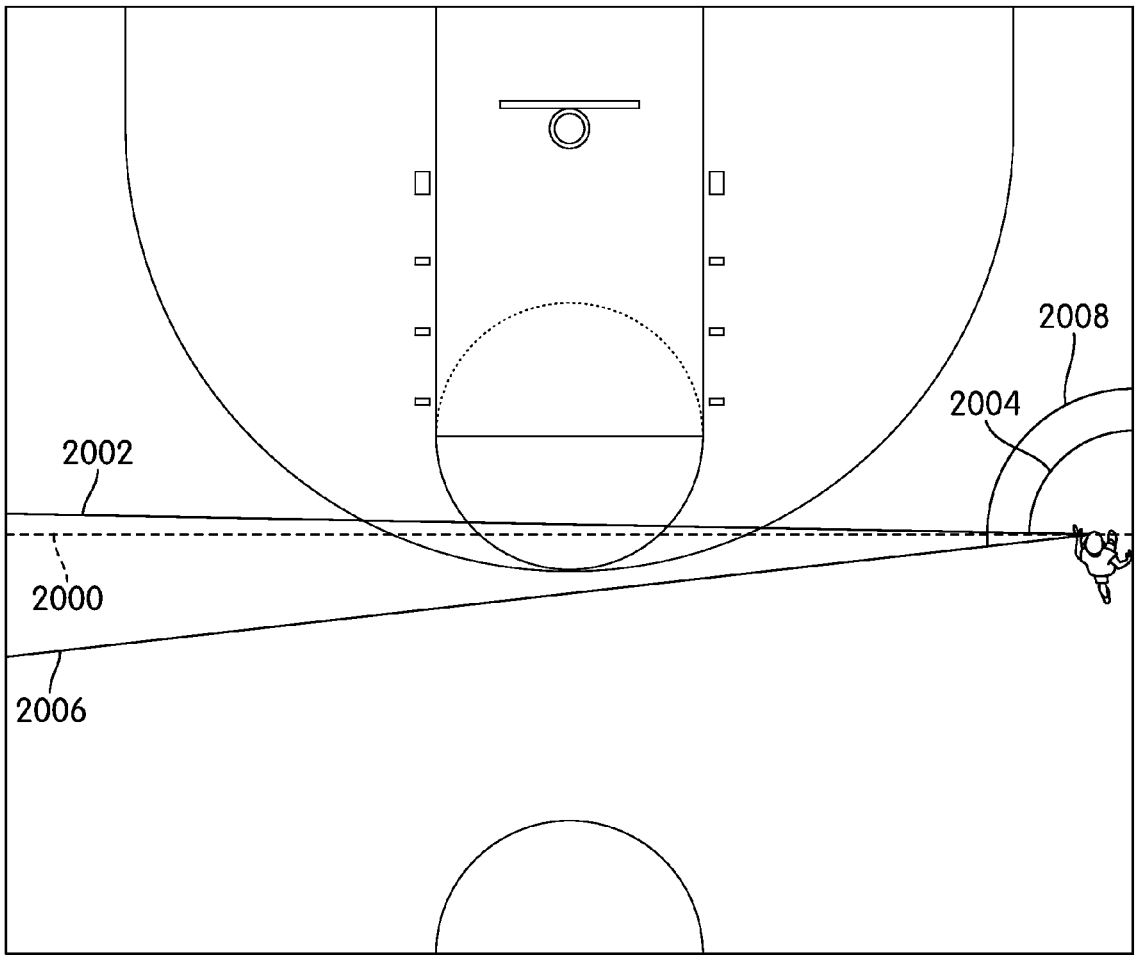
FIG. 22 is a top view of half of a basketball court showing the relative areas in which a user can perceive basketballs from the side of the court.
Figure 23:
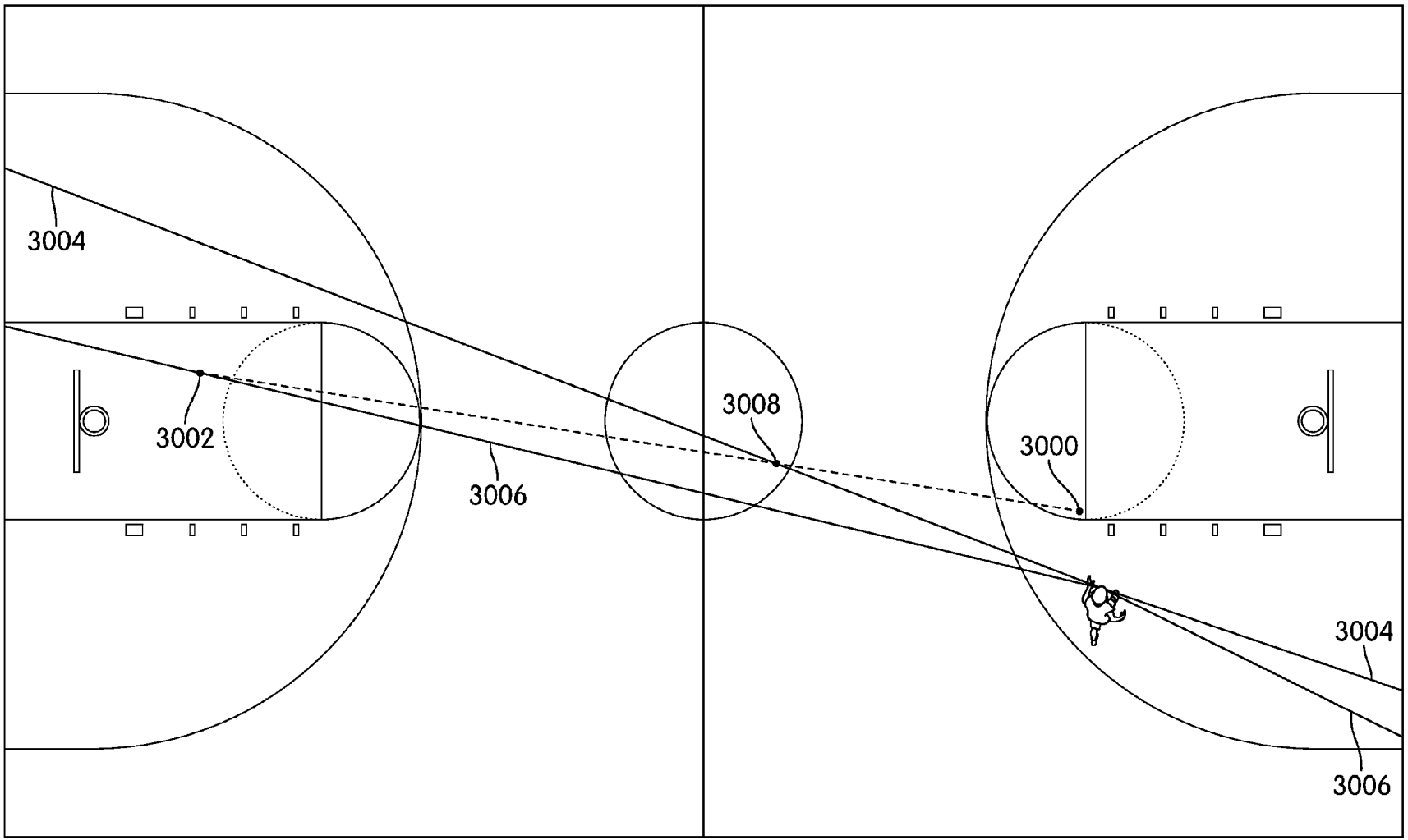
FIG. 23 is top view of a basketball court showing the relative areas in which a user can perceive basketballs from an area near the free throw line.

The results of these tests are shown graphically in FIGS. 21-23. FIG. 21 shows a basketball player positioned near the free throw line and facing the basket. The line 1000 represents 180 degree range from the direction directly to the left of the player to the direction directly to the right of the player. The line 1002 represents the position of the ball where a player would on average detect the ball when the prior art ball of FIG. 1 is used. Accordingly, only when a ball is thrown at a player from a direction that is within angle 1004 will the player detect and react to the ball. This line is a slight amount less than 180 degrees. The line 1006 represents the position of the ball where a player would on average detect the ball when one of the disclosed embodiments is used. When one of the disclosed embodiments is used, when a ball is thrown at a player from a direction within angle 1008, the player can detect and react to the ball. This angle 1008 is greater than 180 degrees.

It is also to be noted that the effect of the flicker is even more pronounced when the ball is on a player's dominant eye side. Eleven of the thirteen subjects were right-eye dominant. Thus, the angle 1010 on the left side of the player is less than the angle 1012 on the right side of the player. The angle 1010 represents the angle greater than 180 degrees on the left side and the angle 1012 represents the angle greater than 180 degrees on the right side. While an examination of this diagram show an enhanced range, FIG. 22 shows a more dramatic range of vision when a player is on one edge of the court.

FIG. 22 shows the enhanced range of visibility with the disclosed embodiments compared with the prior art ball. Line 2000 represents the 90 degree range directly to the left of the player. The line 2002 represents the position of the ball where a player would on average detect the ball when the prior art ball is used. Accordingly, only when a ball is thrown at a player from a direction that is within angle 2004 will the player detect and react to the ball. This line is a slight amount less than 90 degrees. The line 2006 represents the position of the ball where a player would on average detect the ball when one of the disclosed embodiments is used. When one of the disclosed embodiments is used, when a ball is thrown at a player from a direction within angle 2008, the player can detect and react to the ball. This angle 2008 is greater than 90 degrees.

Turning now to FIG. 23, a common basketball situation is illustrated. Specifically, a basketball player may be in a position to receive a long pass from a teammate at the other end of the court, but may not be looking at his teammate. The teammate will pass the ball toward the position the player will occupy when the ball arrives, such as position 3000. The teammate may be, for example, in position 3002. Line 3004 represents the position a prior art ball would have to take before it is detected and line 3006 represents the line the disclosed embodiments would have to take before it is detected. In the case of the disclosed embodiments, the teammate at position 3002 could pass the ball towards position 3000 for the player and the player would be able to detect the motion and react. If a prior art ball were used, the teammate would have to wait to advance the ball to position 3008 to be sure the player would see the ball or alternatively, pass the ball hoping the player would have enough time between when the ball entered his visual field at position 3008 and the time the player reaches position 3000 to see and react to the ball. In such a situation, the time the player has to see the ball and react is greatly increased by using a ball having one of the disclosed embodiments.

It is also helpful to understand that a predictable feel and appearance of the ball is important to most players. Because the size and configuration of the basketball has been so consistent for such a long period of time, basketball players have become accustomed to a particular tactile feeling of the grooves on the body and particular patterns of spin when the ball is thrown, dribbled, and shot. This appearance and tactile feeling enhance a player's ability to perform at a predictable level over time. It may be desirable to maintain the same overall general appearance of the ball so that the players do not need to modify their playing in any way in order to use a ball with enhanced visibility.

The invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. A spheroidal ball, comprising:

a body having an exterior surface having a surface area and a circumference; and first, second, and third grooves on the body, wherein the first, second, and third grooves divide the surface area of the body into eight regions, including three generally rectangular, hourglass-shaped regions and three eye-shaped regions;

wherein the three generally rectangular, hourglass-shaped regions are colored with a first color and the other regions are colored with a second color that contrasts with the first color; and wherein the regions are colored such that no two regions that share a line segment also share a color.

2. The spheroidal ball of claim 1, wherein the first color is generally orange.

3. The spheroidal ball of claim 1, wherein the first color is generally brown.

4. The spheroidal ball of claim 1, wherein the second color has a dominant wavelength between about 520 nm and about 770 nm.

5. The spheroidal ball of claim 1, wherein the first color and the second color are matte.

6. The spheroidal ball of claim 1, wherein the second color covers between about 20% and about 50% of the ball in any orientation of the ball.

7. The spheroidal ball of claim 1, wherein the first, second, and third grooves each divide the surface area of the body into two uneven portions.

8. The spheroidal ball of claim 1, wherein the eight regions into which the surface area of the body is divided by the first, second, and third grooves include two rounded triangular shaped regions.

9. The spheroidal ball of claim 8, wherein the two rounded triangular shaped regions are located on opposite sides of the ball from one another.

10. The spheroidal ball of claim 1, wherein the generally rectangular regions are arranged about the circumference of the ball in alternating fashion, and in an abutting relationship, with the eye-shaped regions.

11. A spheroidal ball, comprising:

a body having an exterior surface having a surface area and a circumference; and first, second, and third grooves on the body, wherein each of the first, second, and third grooves divides the surface area of the body into two uneven portions, and wherein the first, second, and third grooves collectively divide the surface area of the body into eight regions, including three generally rectangular, hourglass-shaped regions;

wherein the three generally rectangular, hourglass-shaped regions are colored with a first color and the other regions are colored with a second color that contrasts with the first color; and wherein the regions are colored such that no two regions that share a line segment also share a color.

12. The spheroidal ball of claim 11, wherein the eight regions into which the surface area of the body is divided by the first, second, and third grooves include two rounded triangular shaped regions.

13. The spheroidal ball of claim 12, wherein the two rounded triangular shaped regions are located on opposite sides of the ball from one another.

14. The spheroidal ball of claim 11, wherein the eight regions into which the surface area of the body is divided by the first, second, and third grooves include three eye-shaped regions.

15. The spheroidal ball of claim 14, wherein the generally rectangular regions are arranged about the circumference of the ball in alternating fashion, and in an abutting relationship, with the eye-shaped regions.

16. The spheroidal ball of claim 15, wherein the eight regions into which the surface area of the body is divided by the first, second, and third grooves include two rounded triangular shaped regions located on opposite sides of the ball from one another; and wherein the generally rectangular, hourglass-shaped regions and the eye-shaped regions are located between the rounded triangular shaped regions.

* * * * *